US005222721A

United States Patent [19]

Miura et al.

[11] Patent Number: 5,222,721

[45] Date of Patent: Jun. 29, 1993

[54] SORTER WITH CASING MOVABLE IN A TRANSVERSE DIRECTION TO THE DIRECTION OF SHEET DELIVERY

[75] Inventors: Kazunobu Miura; Minoru Kawano; Masanobu Kawano; Yoshikazu Maekawa; Osamu Murata; Junzi Sato; Norio Jouichi, all of Hachioji, Japan

[73] Assignee: Konica Corporation, Tokyo, Japan

[21] Appl. No.: 816,297

[22] Filed: Dec. 27, 1991

[30] Foreign Application Priority Data

Jan. 11, 1991 [JP] Japan ..... 3-002086
Jan. 16, 1991 [JP] Japan ..... 3-003380
Jan. 16, 1991 [JP] Japan ..... 3-014902

[51] Int. Cl.[5] ..... B65H 39/02; B42B 2/00
[52] U.S. Cl. ..... 270/58; 270/53
[58] Field of Search ..... 270/45, 52, 53, 58

[56] References Cited

U.S. PATENT DOCUMENTS 4,376,529 3/1983 George et al. ..... 270/53
4,928,941 5/1990 Uto et al. ..... 270/58 X
5,090.673 2/1992 Kitahara et al. ..... 270/58 X

FOREIGN PATENT DOCUMENTS 62-244869 10/1987 Japan .
64-43457 2/1989 Japan .
233456 9/1990 Japan ..... 270/58

*Primary Examiner*—Edward K. Look
*Assistant Examiner*—John Ryznic
*Attorney, Agent, or Firm*—Frishauf, Holtz, Goodman & Woodward

[57] ABSTRACT

A sorter provided with a stapler for use with an image forming apparatus, in which there are provided a plurality of bins each for accommodating various widths of recording sheets delivered from the image forming apparatus, the center of the sheets being positioned in the center of the bins. An aligner aligns the accommodated sheets by pushing the sides of the sheets toward a reference stop wall on each of the bins, and a casing to house the bins is integrated into a unit. The casing is movable in a direction at right angles to a feeding direction of the sheets, and is moved to correspond with the width of the sheets. The home position of the casing is set to a position where the minimum width of sheets are accommodated.

16 Claims, 28 Drawing Sheets

SORTER WITH CASING MOVABLE IN A TRANSVERSE DIRECTION TO THE DIRECTION OF SHEET DELIVERY

BACKGROUND OF THE INVENTION

The present invention relates to a sorter which is provided to an image forming apparatus such as a copier and printer to sort sheets discharged from the apparatus, and more particularly relates to a sorter having a plurality of bins, and the sorter is provided with a stapling device to arrange and staple the sheets in the bin.

For a sheet processing device provided with a stapling device to staple sheets discharged from a copier, printer and the like, a sheet finisher has been utilized which is installed together with an automatic recirculating document handler in order to staple the sheets. However, the aforementioned sheet finisher is disadvantageous because the structure is so complicated and expensive.

(1) In Japanese Patent Publication Open to Public Inspection no. 43457/1989, has been disclosed an apparatus in which a stapling device is provided to a relatively simple bin-moving type of sorter. In the aforementioned apparatus, a stapling device to staple sheets sorted into a bin can be freely moved with regard to the bin.

(2) Another sorter is composed in such a manner that: a fixed type of stapling device is provided to each bin; and the bin is moved to the stapling position so that a bundle of sheets can be stapled.

(3) A sorter disclosed in the official gazette of Japanese Patent Publication Open to Public Inspection No. 244869/1987, is composed in such a manner that: a bin having sheets is moved to a position where a stapling operation can be conducted; the sheets are stapled by a stapling device; and when the sheets in other bins are stapled, the stapling device is moved in a vertical direction.

In the aforementioned sorter of case (1) having a stapling device which can be moved freely, the moving stroke of the stapling device is different according to sheet size. Accordingly, when the vertical spacing of each bin is set large, the sorter size becomes large as a whole, and when the vertical spacing of a bin into which the stapling device is inserted, is extended, the mechanism becomes complicated.

In the aforementioned sorter of case (2), the structure of the sorter is complicated as a whole, and in the case where the vertical spacing of the bin is small, a special stapling device is required.

In the aforementioned sorter of case (3), each bin in which sheets are put, is moved straight along a bin guide at an appropriate time. Accordingly, it is disadvantageous in that the structure becomes complicated.

When various sizes of sheets are discharged from an image forming apparatus in such a manner that the center of the sheets coincides with the center of a bin, and when the sheets in the bin are aligned in such a manner that the sides of the sheets are bumped against a reference face, an alignment rod or plate of an alignment unit must be moved by a long distance. Therefore, the sides of the sheets conveyed into the bin at high speed can not be aligned accurately, so that the sides of the sheets can not be aligned accurately.

Sheets not aligned accurately are disadvantageous when a stapling or punching operation is conducted after the sheets have been sorted.

Further, the present invention relates to a sorter provided with a stapling device which staples the sheets in a bin in such a manner that a shifting frame in which a plurality of bins are disposed, is moved in a direction perpendicular to the sheet conveyance direction.

As sorter systems which automatically sort a plurality of sheets (copy sheets) discharged from an image forming apparatus such as a copier, there are a fixed bin system, an all bin shifting system, and a bin opening movement system.

In the case of the fixed bin system, a plurality of copies are made from a plurality of documents by an image forming apparatus in such a manner that: the sheets conveyed from the image forming apparatus are successively received by a receiving section of a sorter; then the sheets are moved to a conveyance section; as shown in FIG. 1, while the sheets are being conveyed, they are successively taken into bins 41 by a sorting guide 36 and a delivery roller 35 which are installed in the receiving portion of the bin 41.

The aforementioned bin fixed system is advantageous in that: a relatively large number of sheets can be put into the bin: the sorter can respond at a high speed; and a plurality of sorters can be connected. Therefore, this type of sorter is frequently applied to a console type of high speed copier. For example, 50 sheets can be stacked in each of the bins for sorting use, and 250 sheets can be stacked on a tray for non-sorting use.

In the driving means to move the aforementioned frame, there are various plays such as play between a worm directly connected with a motor shaft and a worm wheel, play between the gears of a plurality of gear trains, and play caused by a backlash between a pinion and pinion gear. When these plays are accumulated, play of several millimeters is finally caused. Therefore, a problem is caused in which the stop position of the frame is fluctuated, so that the positions of sheets put in the frame are varied and the stapling positions are remarkably fluctuated.

Further, the present invention relates to a sorter which sorts the sheets discharged from an image forming apparatus in such a manner that the bins are moved from a waiting position to a position corresponding to the sheet size.

A conventional type of sorter will be described as follows.

FIG. 28 shows an outline of sorter B which is connected with the outside of a delivery roller 101 of copier A. When a sort mode is set in sorter B, a route from a passage 103 to a passage 104 is formed by changing over a gate 102. A copied transfer paper (which will be referred to as a paper, hereinafter) discharged by the discharge roller 101, is conveyed upwardly by a conveyance belt 106 of an upward conveyance section 105. When the papers are selectively changed over by a plurality of gates 107, they are discharged into a plurality of bins 109 of a bin shift unit 108 one by one in such a manner that: the first paper is discharged into the uppermost bin, the second paper is discharged into the next bin, and the papers are discharged into the downward bins successively. After a predetermined number of papers have been put into the plurality of bins 109, a paper aligning operation, which will be described later, is conducted. After that, paper bundles in the bins 109 are stapled by a stapling device 110.

FIG. 29 is schematic illustrations which explain the motion of the bin shift unit 108. Before the motion of copier A starts, this bin shift unit 108 is located in a predetermined waiting position (a home position). According to the size of the paper 111 discharged from copier A, the bin shift unit 108 is moved in the direction shown by an arrow D in FIG. 29. In the aforementioned case, the size is defined as a size in the direction perpendicular to discharging direction C, and for example, this size is detected in the process of paper feeding of copier A, and the detected data is sent to sorter B. In the above explanation, the direction indicated by arrow D is a direction vertical to the surface of FIG. 28. As a result, the paper 111 is discharged into the bin 109 in such a manner that one side edge of the paper 111 is positioned close to a side stopper 112 on the side of a stapler 110 in the bin 109. Since the bin 109 is inclined upwardly, the paper 111 discharged onto the bin 109 slips back by its dead weight so that the trailing edge of the paper 111 bumps against a trailing edge stopper 113 to be aligned.

After the last paper 111 has been discharged onto the last bin 109, an alignment rod 115 which is common in all bins and located in a cut-out portion 114 of the bin 109, is moved in the direction of arrow E by the rotation of an arm 116, so that a bundle of the papers 111 on the bin 109 are pushed toward the side stopper 112. As a result, the bundle of the papers 111 are aligned to be stapled appropriately.

After that, as indicated in FIG. 30, stapling operations are conducted on the bundles of the papers 111 from the uppermost bin 109 successively. The tip of an arm 118 rotated by the torque generated by a bin rotating motor 117, is engaged with an engaging portion 119 of the bin 109, and the bin 109 is rotated around a shaft 120 which is common in all bins. In the manner described above, a cut-out edge 121 of the bin 109 is moved to a position of the stapler 110 referred to as a stapling position. Then, the edge of the bundle of the papers 111 is stapled by the stapler 110. After that, the bin rotating motor 117 is reversed, so that the bin 109 is returned to the original position. After all the bundles on the bins 109 have been stapled, the alignment rod 115 is returned to the original position and the bundles of the papers 111 can be taken out from the bins 109.

SUMMARY OF THE INVENTION

The first object of the present invention is to provide a relatively simple sorter with a stapling device which can positively align the papers to be sorted and further conduct a stapling operation at a constant position.

The second object of the present invention is to provide a sorter in which the bins are moved only when the paper size is changed so that the frequency of noise occurrence can be reduced and disorder of the paper bundles can be eliminated.

The first structure of the present invention is improved as follows: instead of moving each bin of the sorter of the aforementioned case (3) at an appropriate time, a plurality of bins are integrally provided in a frame which is formed into one unit, and the frame is moved in the direction perpendicular to the paper conveyance direction corresponding to the paper width.

Further, in the sorter of the present invention, the home position of the aforementioned frame is set to the minimum size paper setting position. In the case of papers, the sizes of which are larger than the minimum size, the operation is performed as follows: when all the papers are taken out from the bins, a detection signal is sent and the aforementioned unit frame is moved from the operation side to the opposite side so that the frame can be automatically returned to the home position.

The second structure of the present invention is characterized in that: in a sorter having a plurality of bins in which various sizes of papers discharged from an image forming apparatus so that the center of the papers can coincide with the center of the bins, are aligned and provided, and having an alignment means by which the papers provided in the bin are moved toward a reference wall, the aforementioned plurality of bins are provided in a frame integrally composed into one unit, and the frame can be moved in the direction perpendicular to the paper conveyance direction, and according to the size of the paper provided in the bin, the aforementioned bin unit is previously moved by a predetermined distance so that the movement amount of the paper by the aforementioned alignment means can be approximately constant without any relation to the paper size.

In the third structure according to the present invention, instead of moving each bin of the sorter of the aforementioned case (3) at an appropriate time, a unit frame in which a plurality of bins are disposed, is moved in the direction perpendicular to the paper conveyance direction correspondingly to the paper width. The aforementioned unit frame in which the plurality of bins are provided, can be moved in the direction perpendicular to the paper conveyance direction correspondingly to the various paper width. The home position of the aforementioned unit frame is set to a housing position of the paper of the maximum size, and when a paper smaller than the paper of the maximum size is provided, the aforementioned unit frame is withdrawn from the operator's side to the opposite side. The home position of the aforementioned unit frame is set to a position where the front side of the frame coincides with the front side of the sorter body. Further, when it is detected that all papers provided in each bin have been taken out, the aforementioned unit frame advances from the operation side to the closer side, and returns to the aforementioned home position.

The fourth structure of the present invention is characterized in that: in a sorter having a plurality of bins in which papers conveyed from an image forming apparatus body, are sorted and provided, and having a stapling device which staples the papers provided in the aforementioned bins, a moving frame in which the aforementioned plurality of bins are disposed, is moved by a drive means in the direction perpendicular to the paper conveyance direction, and a tension coil spring is provided between a mounting portion of the aforementioned sorter body and the aforementioned moving frame, wherein a play caused between the members of the aforementioned drive means can be absorbed by the tension of the aforementioned coil spring.

The fifth structure of the present invention is characterized in that: in a sorter which receives a discharged paper in such a manner that a bin is moved from a waiting position to a position corresponding to the paper size, a means is provided by which a comparison is made between the size of a discharged paper and that of a prior discharged paper, and when the aforementioned sizes are different, the aforementioned bin is moved to a position corresponding to the size of the discharged paper.

DESCRIPTION OF THE PREFERRED EMBODIMENTS

With reference to the drawings, the first embodiment of the present invention will be explained as follows.

Figure 1:
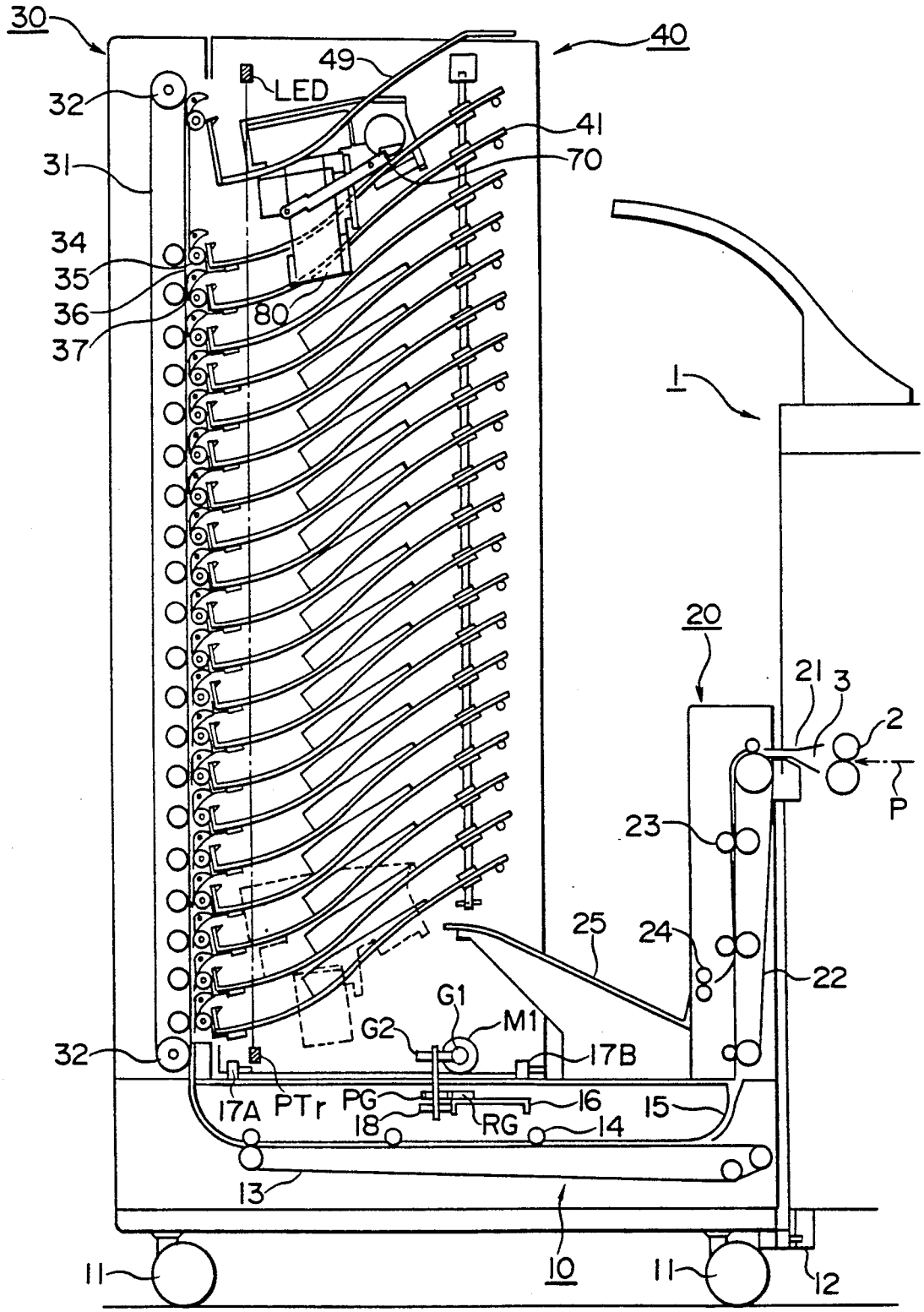
FIG. 1 is a view showing the structure of a sorter connected with an image forming apparatus body according to the first, second, and third embodiments.

FIG. 1 is a view showing the structure of a sorter which is connected with a main body 1 of an image forming apparatus (for example, a copier). The sorter of the present invention comprises a base frame 10, downward conveyance section 20, upward conveyance section 30, and bin shift section 40.

The base frame 10 includes a caster 11, connecting means 12 to connect the base frame 10 with a recording unit, conveyance belt 13, idle roller 14, guide plates 15A, 15*b*, and drive means (not shown in the drawing), and the base frame 10 is fixed to the floor.

The downward conveyance section 20 is connected with paper discharging rollers 2 and a discharging port 3 of the image forming apparatus 1. The downward conveyance section 20 is composed of a guide plate 21 to receive a discharged sheet P so that it can be conveyed downward, a conveyance belt 22 and idle rollers 23 to convey sheet P to the conveyance belt 13 in the aforementioned base frame 10, and the like. A conveyance means 24 and tray 25 are branched from the conveyance passage, which are utilized for discharging a preceding sheet in the image forming apparatus 1 when a jam has occurred in an ADF or a sorter. The upper portion of the frame corresponding to the aforementioned downward conveyance section 20 is freely opened and closed so that a jammed paper in the downward conveyance section 20 can be removed.

In the upward conveyance section 30, several endless conveyance belts 31 are provided between pulleys 32 and 33 which are rotatably mounted on the upper and lower portion of the support frame. A plurality of rollers 34 corresponding to the insert ports of the bins are provided inside the conveyance belt 31 in such a manner that the rollers 34 are rotatably contacted with the conveyance belt 31. A plurality of conveyance rollers 35 are provided outside the conveyance belt 31 correspondingly to the rollers 34 in such a manner that the conveyance rollers 35 are rotatably contacted with the conveyance belt 31.

Branch guides 36 are disposed between the conveyance rollers 35 at the entrances of the bins, and oscillated to guide the papers. These branch guides 36 are rotatably supported by shafts 37 which are provided to the aforementioned support frame, and oscillated by levers provided at the ends of shafts 37 and solenoids, wherein the levers and solenoids are not illustrated in the drawing. Accordingly, when a branch guide 36 is rotated clockwise, the lower edge claw portion of the branch guide 36 is crossed with a paper conveyance passage composed of the conveyance belt 31 and the conveyance roller 35 so that the paper can not be conveyed upward. In this way, the branch guide 36 is prepared for receiving papers. When a paper P is conveyed under the aforementioned condition, paper P is curved along the inner curved surface of the branch guide 36 in the direction of a right angle, and paper P is received by bin 41.

Figure 2:
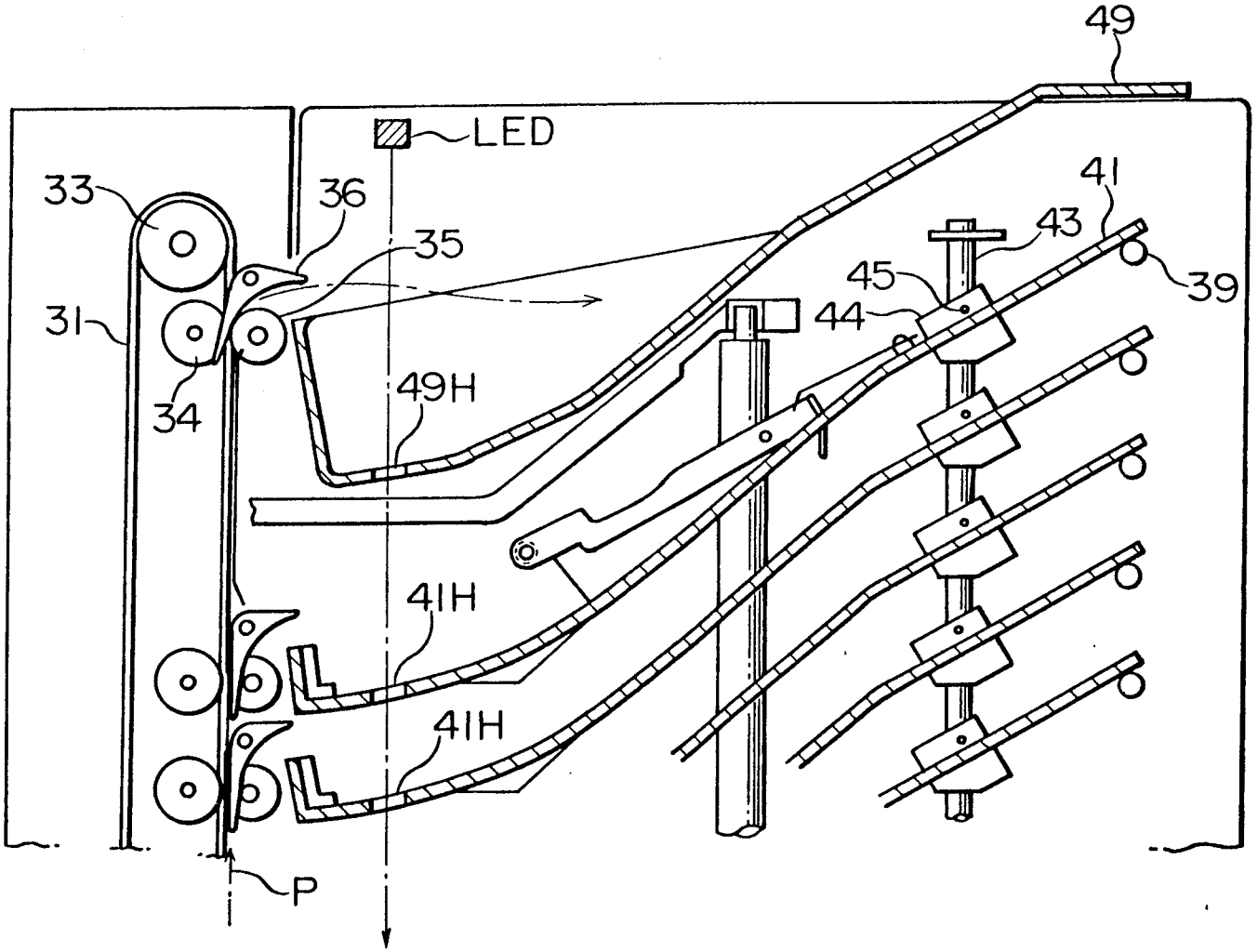
FIG. 2 is a partial sectional view of the members of the branched conveyance passage for papers and the upper bins of the sorter.
Figure 3:
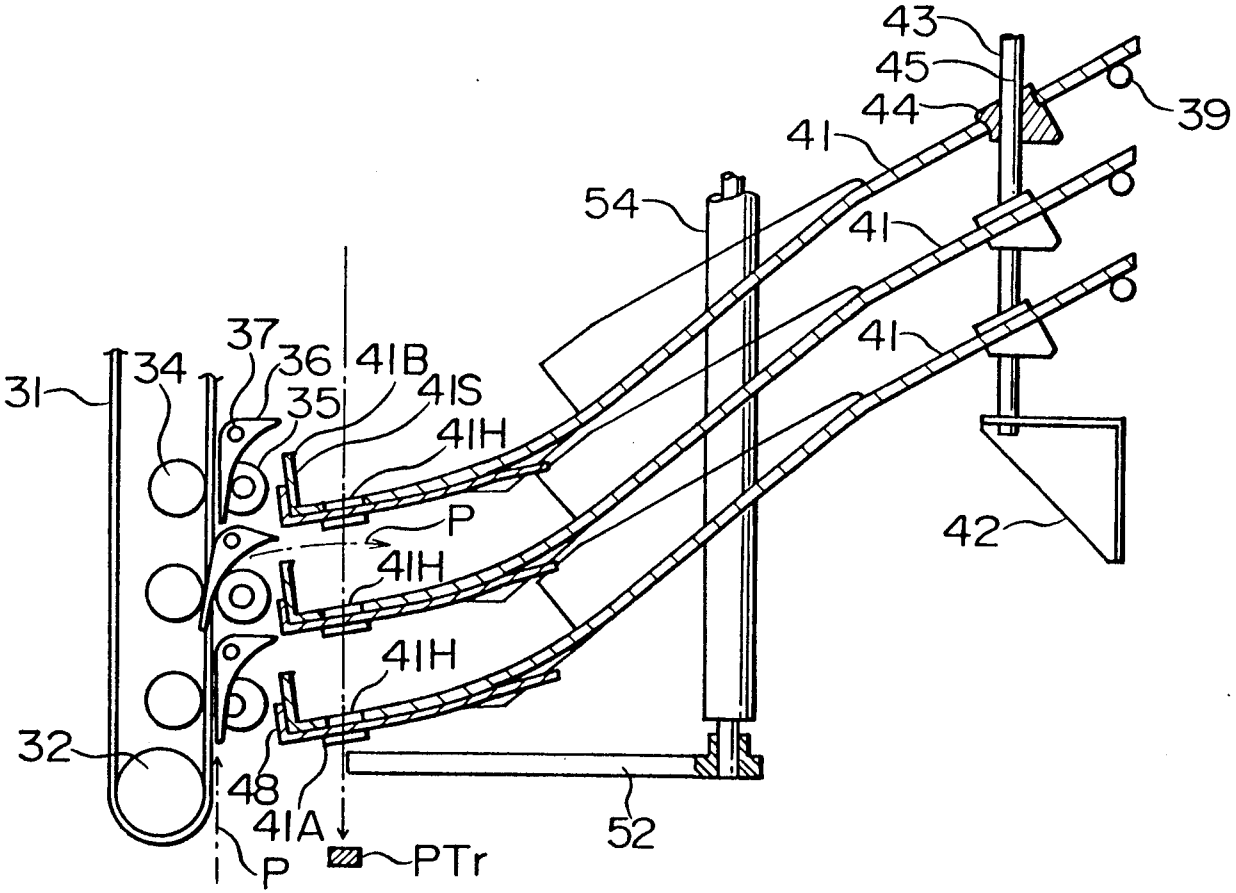
FIG. 3 is a partial sectional view of the lower portion of the sorter.

FIG. 2 and FIG. 3 are partial sectional views of the composing members of the aforementioned branch conveyance passage and the bin. FIG. 2 shows the upper portion of the sorter, and FIG. 3 shows the lower portion of the sorter.

In the bin shift section 40, a plurality of bins (for example, 20 bins) 41 which are disposed at regular intervals, are supported in such a manner that the bins can be freely oscillated. That is, the bottom portion (the left portion shown in FIG. 3) of the bin 41 is slidably supported on a guide plate 48 which is fixed to the bin shift section 40.

A vertical fixed shaft 43 which is supported by supporting members 42 mounted on the upper and lower portions of the frame of the bin shift section, is engaged with a slide member 44 which is positioned by a pin 45. The slide member 44 is inserted into a hole formed at one end (the right upper portion shown in FIGS. 2 and 3) of the aforementioned bin 41, so that the bin 41 can be freely rotated. The pins 45 mounted on the fixed shaft 43 at regular intervals, are engaged with the cutout portions of the slide members 44, so that the edge portions of the bins 41 are held in parallel at regular intervals.

The other end portion of the bin 41 is supported by a rotatable roller 39 which is mounted on a portion of the frame of the bin shift section 40. In the manner described above, the bin 41 is supported by the guide plate 48, slide member 44 and roller 39, and freely rotated around the fixed shaft 43. Numeral 41A in the drawing represents 3 claws which engage with cut-out portions of the guide plate 48. Numeral 41B represents 5 front stoppers provided on the paper guide side of the upper surface of the bin 41. The upper edge of the vertical surface of the stopper is curved so that it can be formed claw-shaped in order to prevent a paper from getting out of the bin in the case where the trailing edge of the paper is raised.

Figure 4:
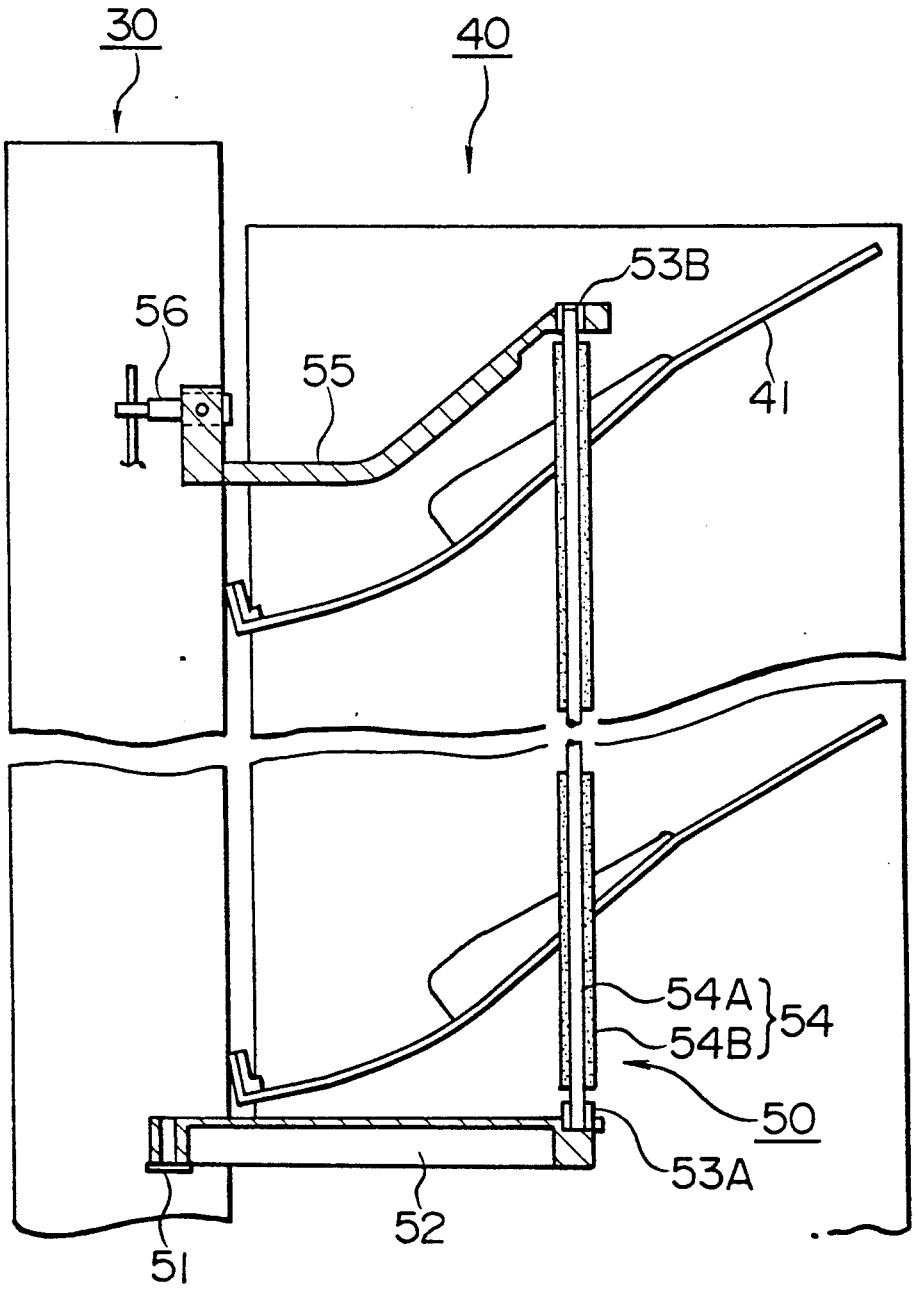
FIG. 4 is a sectional front view of the alignment device.
Figure 5:
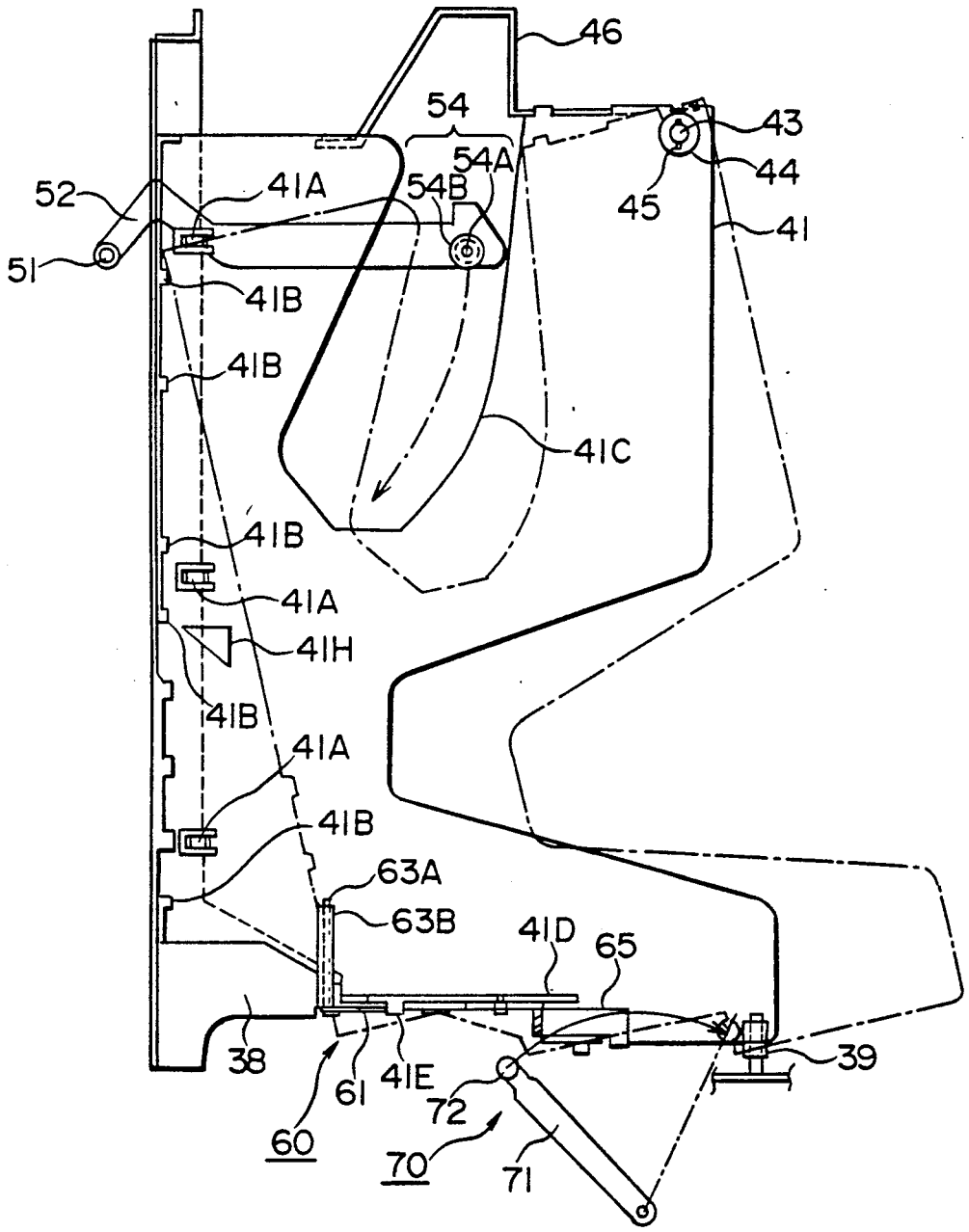
FIG. 5 is a plan view of the bin, alignment device and paper holding device.

On the other hand, an alignment member 50 which aligns the side of paper P discharged from the copier 1 onto the bin 41, is provided in one portion of the fixed frame of the upward conveyance section 30. FIG. 4 is a sectional front view of the alignment device 50, and FIG. 5 is a plan view of the alignment device 50.

In the alignment device 50, a lower arm 52 is engaged with a lower shaft 51 mounted on the lower portion of the aforementioned frame so that it can be freely oscillated by a pulse motor (not illustrated in the drawing). A lower shaft end of a core bar 54A of an alignment rod 54 is supported by an aligning bearing 53A at the tip of the lower arm 52. The circumference of the core bar 54A of the alignment rod 54 is covered with a resilient member 54B made of a foam material such as sponge, and the resilient member 54B is contacted with the side of paper P so that the side of paper P can be aligned.

An upper shaft end of the core bar 54A of the aforementioned alignment rod 54 is supported by an aligning bearing 53B mounted on the shaft end of an upper arm 55. The upper arm 55 is engaged with an upper shaft 56 mounted on the upper portion of the aforementioned frame so that the upper arm 55 can be rotated.

An arc-shaped curved portion 52A is protruded from a portion of the aforementioned lower arm 52, and when an optical path of a photo-interrupter 57 is interrupted, the home position of the lower arm is detected.

The oscillating angle of the aforementioned lower arm 52 can be changed when the setting pulse number of the aforementioned pulse motor is changed so that paper P can be aligned in accordance with the size of paper P.

A roller 58 is rotatably engaged with a protruded shaft portion 52B which is protruded from a portion of the aforementioned lower arm 52. The roller 58 is slidably contacted with a groove cam portion 59A of a cam member 59 which is fixed to the aforementioned frame. Accordingly, when the lower arm 52 is oscillated around the lower shaft 51, the lower arm 52 is also oscillated in the direction of the shaft. When the aforementioned oscillation is conducted, papers P put on the bin 41 are aligned by the oscillation of the alignment rod 54, and the side of the paper can be pressed downward so that the paper can be aligned.

Figure 6:
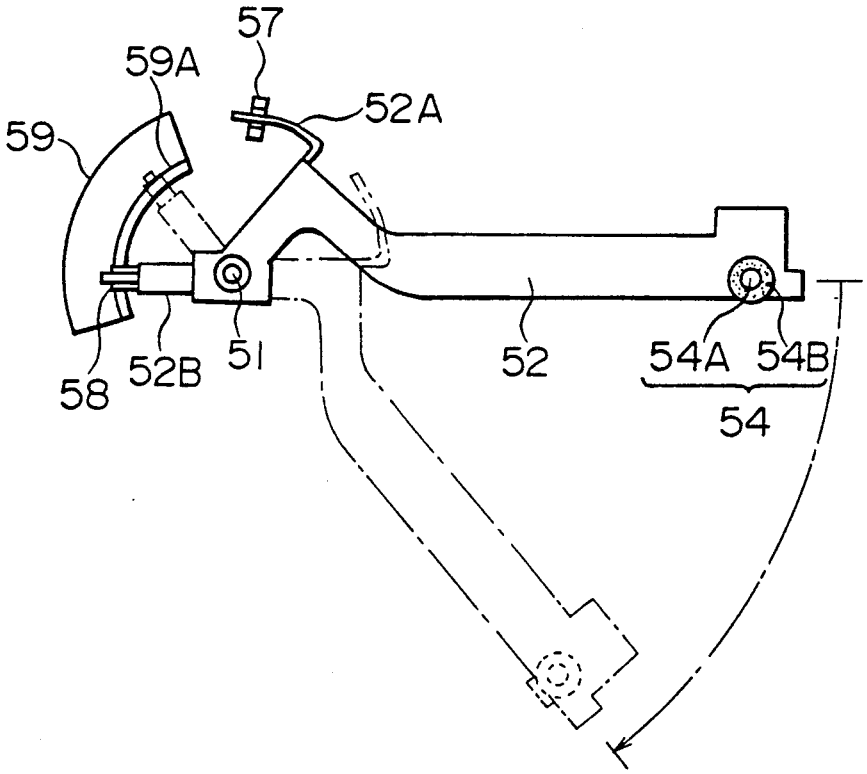
FIG. 6 is a front view of the alignment device.

The aforementioned alignment rod 54 moves along a locus which is shown by a one-dotted chain line in FIG. 6. On the other hand, in order to insert papers on the bin 41 into a stapling member, the bin 41 is oscillated as shown by a one-dotted chain line in FIG. 5. Since the bin 41 is moved forward and backward, a large curved opening portion 41C is formed in the bin 41 as shown in the drawing so that the alignment rod 54 can not interfere with the bin 41. Numeral 46 is a reinforcing member to reinforce the opening portion 41C of the bin 41 in order to prevent deformation of the bin 41 caused by the opening portion 41C. This reinforcing member is fixed to the side of the bin 41 by screws, and at the same time engaged with a groove of the bin 41 into which the aforementioned slide member 44 is inserted, in order to prevent the slide member 44 from getting out.

Figure 7:
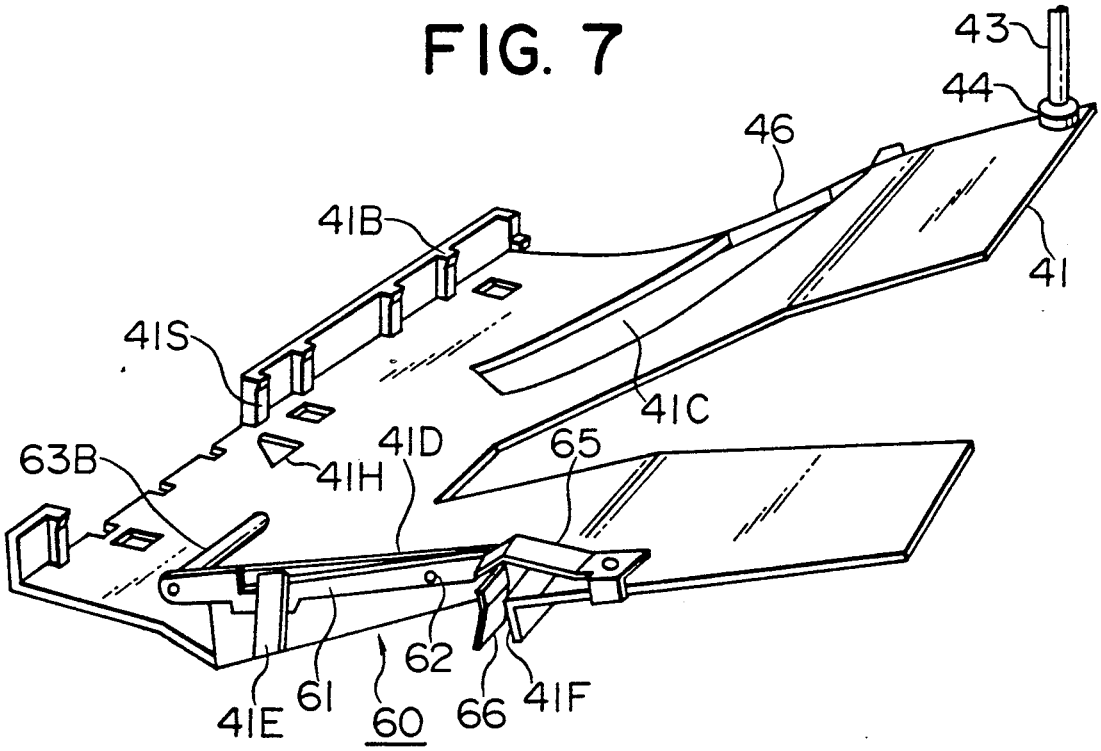
FIG. 7 is a perspective view of a bin to which the paper holding device is provided.

A vertical stopper wall 41D is integrally provided on the side of the aforementioned bin 41. A paper holding device 60 is mounted on the outer side of the aforementioned stopper wall 41D. FIG. 7 is a perspective view of the bin 41 to which the paper holding device 60 is provided. A lever 61 is supported by a shaft 62 mounted on the outer side surface of the stopper wall 41D in such a manner that the lever 61 can be freely oscillated. Numeral 41E is a guide portion to slidably guide the lever 61. A long and slender shaft 63A is mounted on the tip of the lever 61, and a pipe-shaped member 63B is provided around the shaft 63A with a play. The other end of the aforementioned lever 61 is resiliently pressed by a leaf spring 65. A leaf spring 66 is supported and fixed in the manner of a cantilever at a bending portion located under a position where the lever 61 is pushed by the spring. The leaf spring 66 is pushed by a roller 72 mounted on the tip of the second arm 71B of a bin oscillating device 70.

Figure 8:
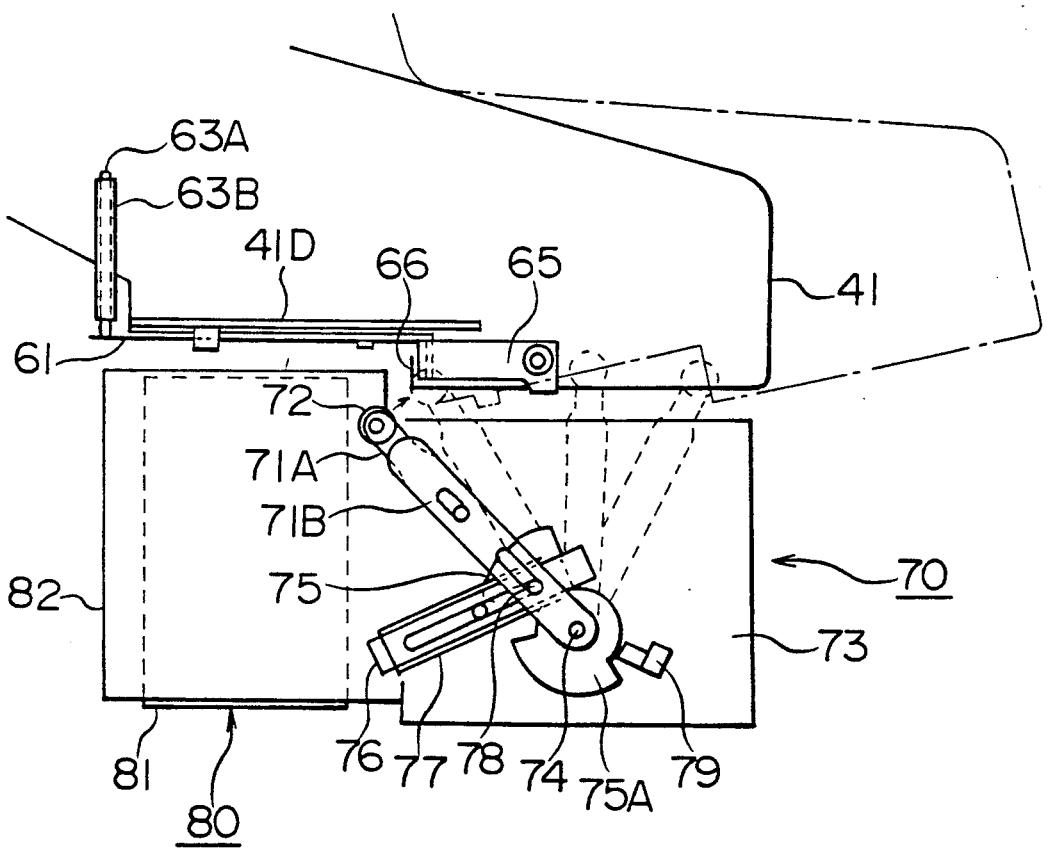
FIG. 8 is a plan view of a bin oscillating device.

FIG. 8 is a plan view of the bin oscillating device 70 which oscillates the aforementioned bin 41 and at the same time activates the aforementioned paper holding device 60.

The bin oscillating device 70 is mounted on a base plate 73. The first arm 71A is coaxially provided to a rotating shaft 74 which is driven by a motor and reduction gear train not illustrated in the drawing. The second arm 71B having long holes is provided to the first arm 71A in such a manner that it can be slid in the radial direction being pushed by a spring. A rubber coated roller 72 is mounted on the tip of the second arm 71B.

A cam plate 75 is provided to the aforementioned rotating shaft 74, and the cam plate 75 is composed of a U-shaped groove and an arc portion having the same radius.

On the other hand, a follower shaft 78 is supported being pushed by a spring, wherein the follower shaft 78 penetrates through a long groove portion of a moving member 77 which slides straight on a guide member 76 mounted on a portion of the base plate 73, the aforementioned first arm 71A, and the second arm 71B.

A semicircular shut-off plate 75A is integrally provided at the other end of the aforementioned cam plate 75, so that a photo-interrupter 79 is turned on and off.

When the aforementioned first arm 71A is rotated clockwise as shown by a broken line in FIG. 8, the follower shaft 78 moves the groove portion of the moving member 77 and at the same time moves the groove of the cam plate 75 to the outside. After the follower shaft 78 leaves the grooves, it slides on the curved surface of the arc portion having an equal radius. Before the aforementioned operation, the shielding plate 75A of the tail portion of the cam plate 75 interrupts the optical path of the photo-interrupter 79 so that the power source is turned off and the rotation of the motor is stopped. Consequently, even when there is an overrun after the motor has been stopped, the follower shaft 78 moves and stops on the arc portion having the equal radius of the cam plate 75, so that the first arm 71A maintains its stop position at a predetermined angle. Accordingly, the bin 41 stops at a predetermined position. The base plate 73 of the aforementioned bin oscillating device 70 is mounted on the common frame 82 together with the base plate 81 of the stapling device. The base plate 73 moves vertically on the frame of the aforementioned bin shift section 40, and stops at each bin 41. Then, a bundle of papers stacked on the aforementioned oscillated bin 41 being held by the aforementioned paper holding device 63B, enter into a stapling gap of the stapling device to be stapled.

After the bundle of papers have been stapled, the second arm 71B is oscillated back so that the bin 41 is returned to the original paper discharging position being pushed by a spring.

Next, the stapling operation conducted on the bundle of papers discharged in the bin 41, will be explained as follows.

The position of a document on the platen glass of the copier 1 can be determined in two ways, one in which the document is set so that the center of the document can coincide with the center line of the copier, and the other in which the document is set so that one side of the document can coincide with a reference line. The stapling operation conducted in the former case will be explained here.

When the size of a paper P (a copy paper) discharged from the image forming apparatus 1 is set manually or automatically, the bin shift section 40 of the sorter is driven electrically, and when the bin has reached a predetermined position corresponding to the size of the aforementioned paper, the bin stops according to a signal sent from a position detecting sensor. Therefore, the bin is set in a waiting condition. When the bin 41 is in the aforementioned waiting position, a stopper wall 41D of the bin 41 is located in a position separated from the side of paper P entering into the bin, by the distance of δ (for example, 10 mm).

Figure 9:
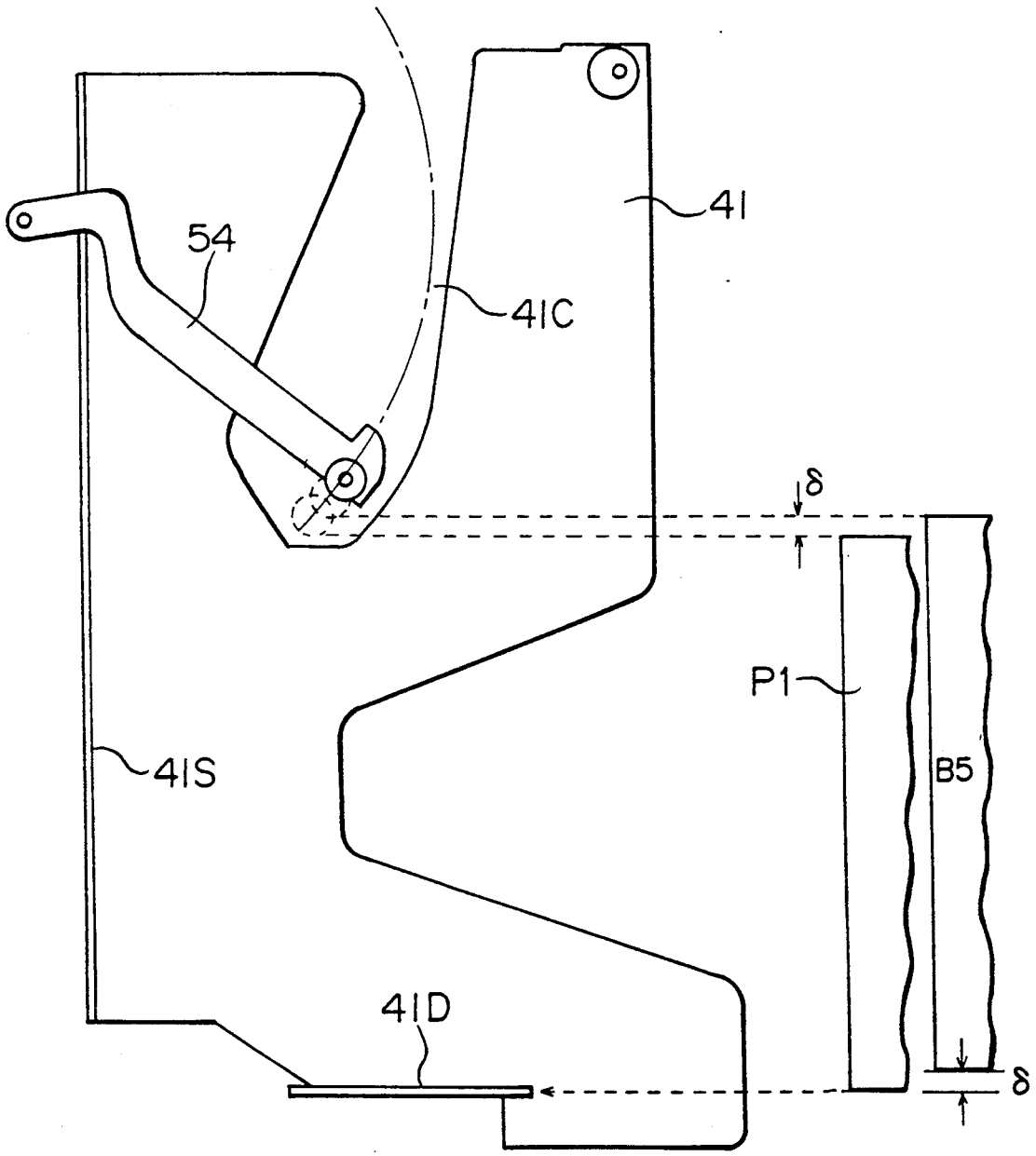
FIG. 9 is a plan view showing the bin in which a paper of the minimum size is held, and the alignment device.

FIG. 9 is a plan view showing an operation in which the minimum size of paper P (for example, B5-size, the width of which is 257 mm) is discharged in such a manner that the center of paper P coincides with the center line of the copier, and the side of paper P is aligned. In the aforementioned condition, the bin shift section 40 of the sorter is located in the home position, and the front surface of the bin shift section 40 is set on the same surface as that of other fixed portions of the sorter such as the base 10, the downward conveyance section 20, and the upward conveyance section 30.

In the aforementioned condition paper P1 enters from the left in the drawing, and moves upward along the inclined surface of the bin 41. After that, paper P1 slides down by its dead weight and bumps against a front stopper 41S to be stopped.

After paper P has been stopped, the alignment rod 54 is oscillated and pushes one side edge of paper P to move it toward the viewer's side by the distance of δ, so that the other side edge of paper P1 can be contacted with the stopper wall 41D. This distance δ is set to almost the same in the case of other sizes (for example, A4 size, B4 size and A3 size).

Figure 10:
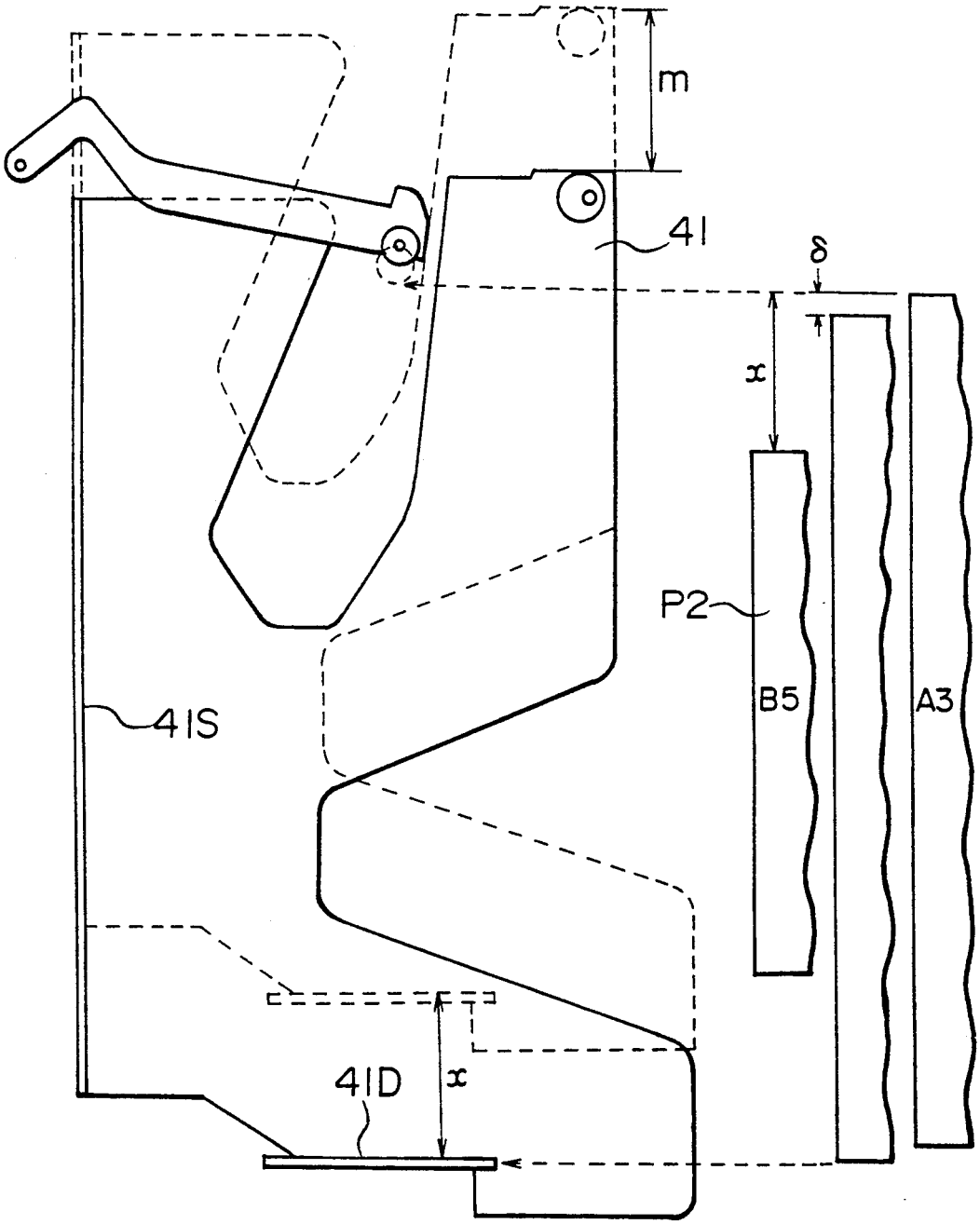
FIG. 10 is a plan view showing the bin in which a paper of the maximum size is held, and the alignment device.

FIG. 10 is a plan view showing the condition in which the maximum size of paper P2 (for example, the width is 17 inches) is held in the bin 41 and aligned so that the center of the paper can coincide with the center line of the copier. When the size of paper P conveyed out of the image forming apparatus 1 is set manually or judged automatically, the bin shift section 40 of the sorter is electrically driven to the viewer's side and moved from the position shown by a broken line to the position shown by a solid line by displacement X, and then the bin 4 shift section 40 is stopped at a predetermined position BL (base line) which is common in all sizes of paper P. When the bin shift section 40 is moved by displacement X, the stopper wall 41D reaches the same position as that of the aforementioned minimum size of paper P1.

That is, this displacement X is determined in such a manner that: the minimum size (for example, B5 size, 257 mm) of paper P is subtracted from the maximum size (for example, 17 inches); and the obtained value is divided by 2 to find the value of 87.4 mm. While the bin shift section 40 is moved, the side edges of the bundle of papers on the bin 41 are pushed by the alignment rod 54 to be moved. Consequently, the distance δ for aligning papers is constant in all sizes, so that a paper aligning operation can be conducted uniformly at the same speed and force.

Papers of the middle size are moved to the stop position of base line BL, and then the side edges are aligned in the same manner as described above.

Figure 11:
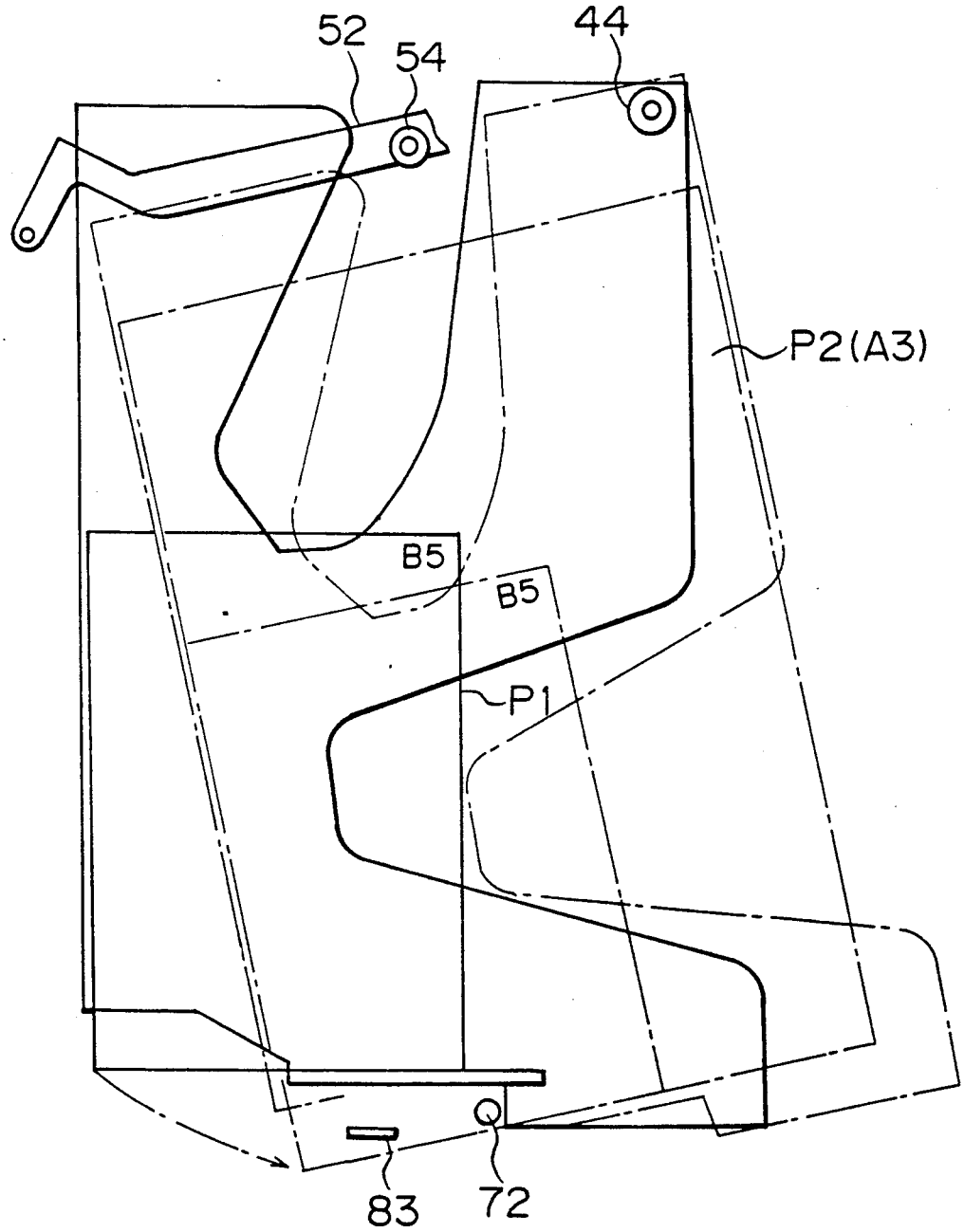
FIG. 11 is a plan view showing the oscillating process of a bin.

FIG. 11 is a plan view showing an oscillating process in which a stapling operation is conducted.

In the manner described above, paper P which has been discharged from the image forming apparatus is pushed against the stopper wall 41D by the oscillating alignment rod 54 one by one so that the paper can be aligned to base line BL.

When it is judged that all the papers, the number of which is set previously, are held in the bin 41, the second arm 71B of the aforementioned bin oscillating device 70 starts oscillation, and the lever 61 is oscillated by the roller 72 provided to the tip of the arm 71B, and the paper holding member 63B presses the bundle of papers downward so that slippage of the papers can be prevented.

When a stapling signal is inputted into the bin shift section 40 which is stopped, the aforementioned bin oscillating device 70 is driven first, and then the arm 71B is oscillated, so that the roller 72 provided to the tip of the arm 71B presses one end of the aforementioned paper holding device 60. Then, the bin 41 is oscillated around the slide member 44 (the oscillating angle is about 12.) and stopped.

At this stop position, the leading edge corner of the bundle of papers is inserted into a gap for stapling formed in the stapling device 80, and then the stapling device 80 is driven so that the bundle of papers can be stapled.

After the stapling operation has been completed, the arm 71B is returned, so that the bin 41 is pushed by the spring and returned to the original position, and at the same time the paper holding member 62B is separated from the surface of the bundle of papers. Therefore, the bundle of papers can be taken out of the bin 41.

After the bundle of papers held in the uppermost bin 41 have been stapled, the common frame 82 in which the stapling device 80 and the bin oscillating device 70 are integrally provided, is lowered by a drive unit, and the bin 41 which is located under the uppermost bin is oscillated so that the same stapling operation can be conducted. During the aforementioned operation, a paper discharging operation is conducted in the bin 41 located in the further lower position.

Then, the stapling device 80 integrated with the bin oscillating device 70, is successively lowered or raised, and the bundle of papers in the second bin and that in the third bin are stapled in order. After each stapling operation has been completed, the number of the stapling operations and that of copies with regard to each document are compared, and the moving and stapling operation of the stapling device are continued until both numbers become the same. When both numbers become the same, all the stapling operations are completed, and the stapling device 80 returns to the stapling position of the first bin to prepare for the next operation.

After all the bundles of papers have been stapled, the bundles are taken out from the bins 41. When all the bundles are removed from the bins 41, the optical path is opened which is formed by a light emitting element LED provided in the upper portion of the bin shift section 40, a light receiving element $PT_r$ provided in the lower portion, and the openings 41H, 49H. Then, a detection signal representing that there is no paper P on the bin 41, is emitted.

Figure 12:
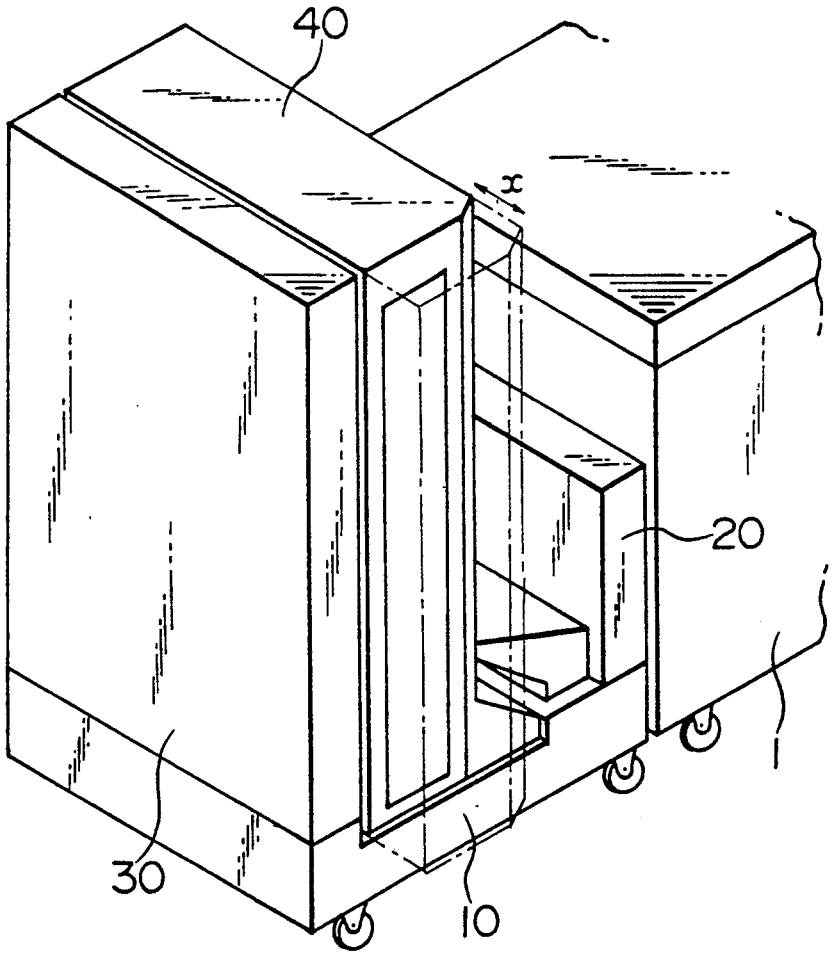
FIG. 12 is a perspective view showing the appearance of a sorter.

According to the detection signal, the bin shift section 40 is moved by a motor and a transmitting unit composed of a rack and pinion, resisting the spring force, so that the bin shift section 40 returns to the home position and prepares for the next operation. That is, when sheets, the size of which larger than the minimum size (B5), are held, the bin shift section 40 is moved to the operator's side (front side) so that the sheet holding and stapling operation can be conducted as described above, so that after all the sheets have been stapled, the bin shift section 40 is withdrawn to the side far from the operator. Accordingly, when the operator removes all the bundles of stapled sheets from the bins 41, the bin shift section 40 withdraws, reaches the home position, and stops. FIG. 12 is a view showing the appearance of the sorter according to the present invention. In the drawing, a solid line represents a condition in which the bin shift section 40 is located in the home position, and a one-dotted chain line represents a condition in which the bin shift section 40 has advanced.

Referring now to the drawings, the second embodiment of the present invention will be explained as follows. Like parts in each of the drawings are identified by the same reference character. Only the points different from the first embodiment will be explained here.

A stay member 16 is provided to the base frame (the horizontal conveyance section) 10 in the direction perpendicular to the surface of FIG. 1. A rack gear RG is fixed on the upper surface of the stay member 16.

On the other hand, rollers 17A, 17B used to move the frame are rotatably provided in the frame of the bin shift section 40. The aforementioned rollers 17A, 17B move on rails of the aforementioned base frame 10, wherein the rails are not illustrated in the drawing. Therefore, the frame of the bin shift section 10 can be moved in the direction perpendicular to the surface of the drawing. A motor M1 is provided inside the frame of the bin shift section 40. Motor M1 drives pinion gear PG through gears G1, G2. Since pinion gear PG meshes with rack gear RG fixed to the aforementioned stay member 16, the frame of the bin shift section 40 is moved in the direction perpendicular to the surface of the drawing when motor M1 is rotated.

Numeral 18 is a roller which is provided on the shaft of the aforementioned pinion gear PG, and the roller 18 is slidably contacted with the aforementioned stay member 16 to guide it.

When all the stapling operations have been completed, the stapling device 80 returns to the stapling position of the first bin and waits for the next operation. When all the bundles have been stapled, the bin shift section 40 returns to the home position and waits for the next operation. This home position is located in the place where the bin shift section 40 is withdrawn most. However, the most advanced position may be set as a home position for papers of a large size, and when papers of a small size are held, the bin shift section 40 may be withdrawn.

Referring now to the drawings, the third embodiment of the present invention will be explained as follows. Like parts in each of the drawings are identified by the same reference character. Only points different from the aforementioned second embodiment will be explained.

The downward conveyance section 20 and upward conveyance section 30 are fixed on the upper surface of the base frame 10 in FIG. 1. The bin shift section 40 can be moved in the direction perpendicular to the surface of the drawing.

Figure 13:
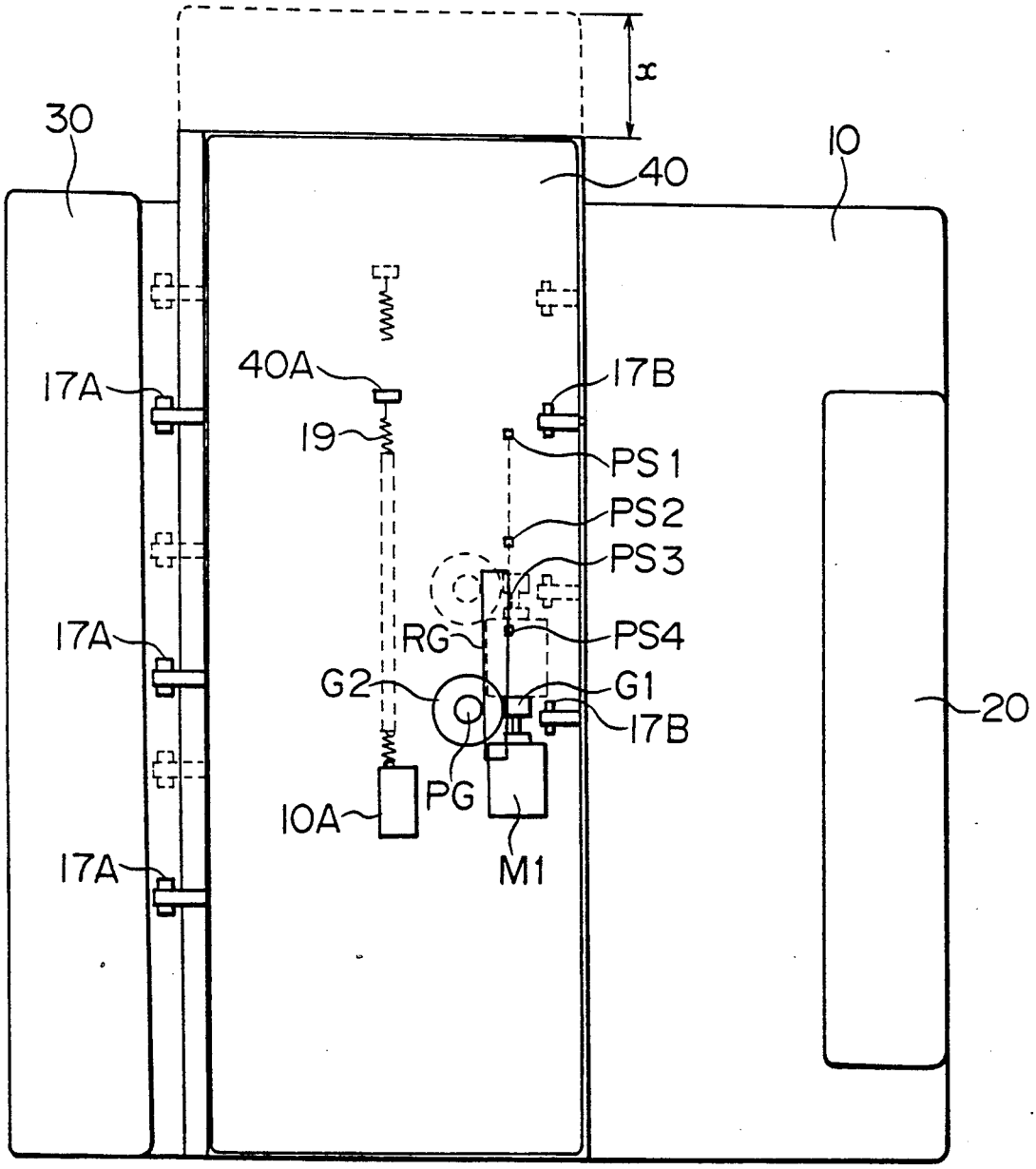
FIG. 13 is a plan view showing a base frame and a bin shifting section drive means of the third embodiment.

FIG. 13 is a plan view of a drive means of the base frame 10 and bin shift section 40.

Motor M1 is provided inside the frame of the aforementioned bin shift section 40, and rotates pinion gear PG through gears G1, G2. Since pinion gear PG meshes with rack gear RG fixed to the aforementioned stay 16, the frame of the bin shift section 40 is moved to a position illustrated by a broken line in FIG. 13 when Motor M1 is rotated. Numeral 18 is a rotatable roller mounted on the shaft of the aforementioned pinion gear PG. The roller 18 comes into contact with the aforementioned stay 16 so as to guide. Numeral 19 is a tension spring stretched between the engaging portion 10A of the base frame and the engaging portion 40A provided to a portion of the bin shift section 40 so that the bin shift section 40 can be pushed in a direction by the force of the spring.

The aforementioned frame of the bin shift section 40 is provided with photo-sensors PS1, PS2, PS3 and PS4. The aforementioned photo-sensors detect the home position of the frame, for example, the position where the maximum size 17 inches of sheets are held, and further detect the positions where the sheets having the sizes of A3, B4, A4, B5 are held. When the position is detected, the movement of the frame is stopped.

Figure 14:
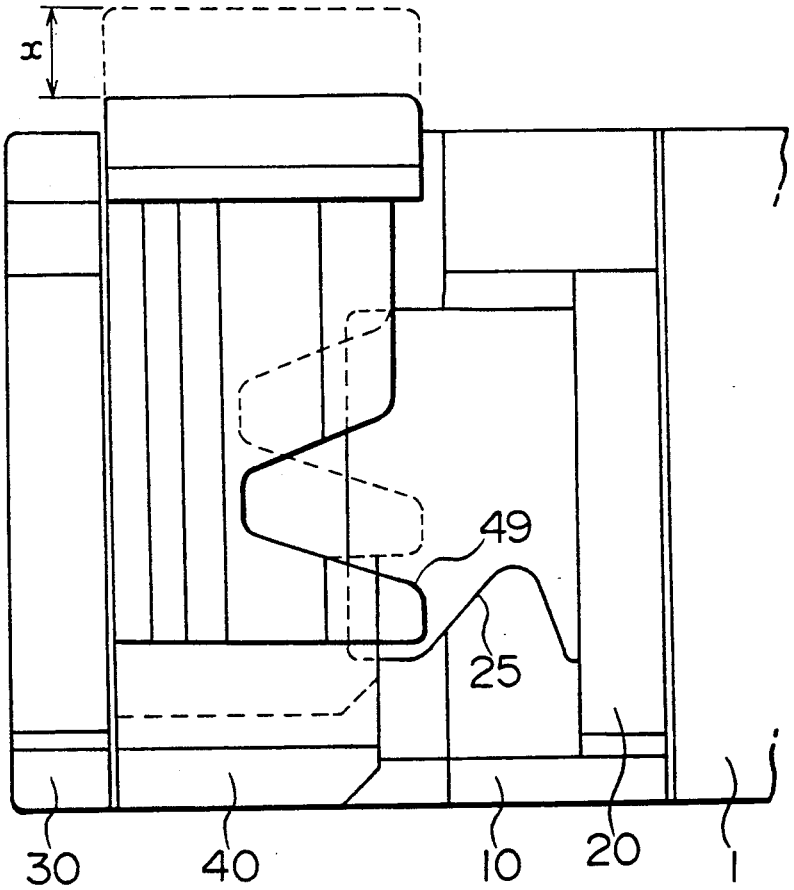
FIG. 14 is a plan view of the sorter.
Figure 15:
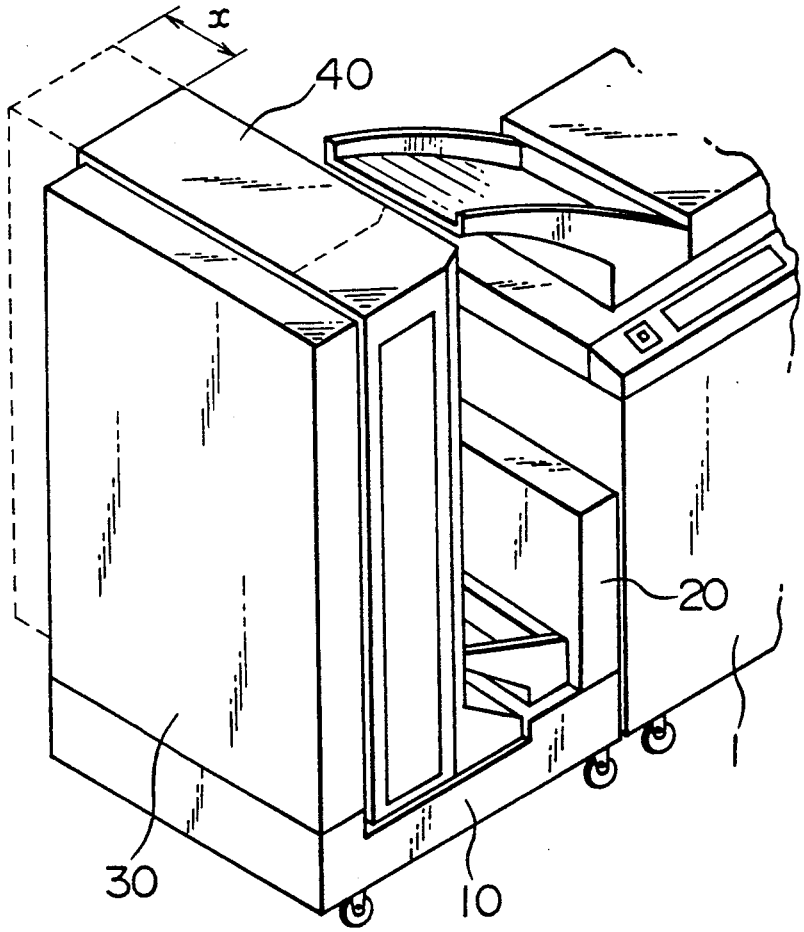
FIG. 15 is a view showing the appearance of the sorter.

FIG. 14 is a plan view of the sorter showing the operation of the bin shift section 40, and FIG. 15 shows the appearance of the sorter. A solid line in the view shows a condition in which the bin shift section 40 is moved to the home position, and a broken line shows a condition in which the bin shift section 40 is withdrawn.

When sheets of the maximum size, for example, sheets having the width of 17 inches, are held in the bins, the bin shift section 40 is set to the home position on the operator's side.

When sheets smaller than the maximum size are held in the bins, the bin shift section 40 is entirely withdrawn to the side opposite to the viewer's side.

When papers are discharged from the image forming apparatus in such a manner that the center of the discharged paper coincides with the center line of the apparatus, the maximum amount of movement X of the bin shift section 40 is set to the value which is found in such a manner that a value obtained by subtracting the minimum size (for example, B5 size, 257 mm) from the maximum size (for example, 17 inches) is divided by 2, for example, 87.4 mm is obtained.

A non-sorting tray 49, the bottom portion of which is deeply curved, is fixed to the upper portion of the aforementioned plurality of bins (20 sorting bins illustrated in FIG. 1). The aforementioned non-sorting tray 49 is a tray to hold copied papers which do not require to be sorted. On the non-sorting tray, numerous papers, for example, 100–300 sheets of papers can be stacked. Command of a sorting or grouping operation can be given through a control panel provided to the image forming apparatus.

In the sorter provided with the stapling device, in order to insert papers P stacked on the bin 41 into the stapling device, all the bins 41 are advanced or withdrawn by motor M1 correspondingly to the paper size as shown in FIGS. 13, 14, 15. Further, each bin is oscillated around the fixed shaft 43.

Figure 16:
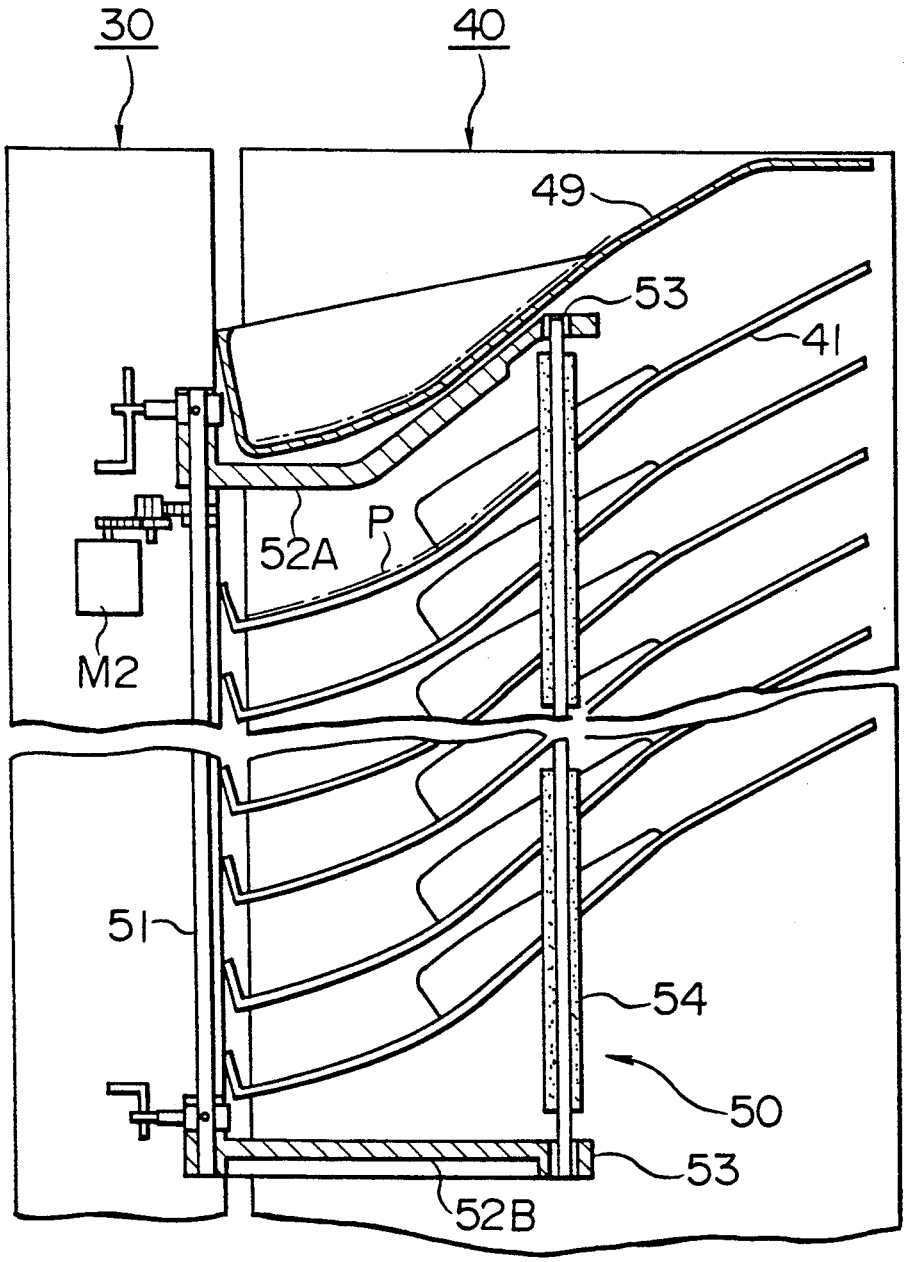
FIG. 16 is a sectional front view of the alignment device.
Figure 17:
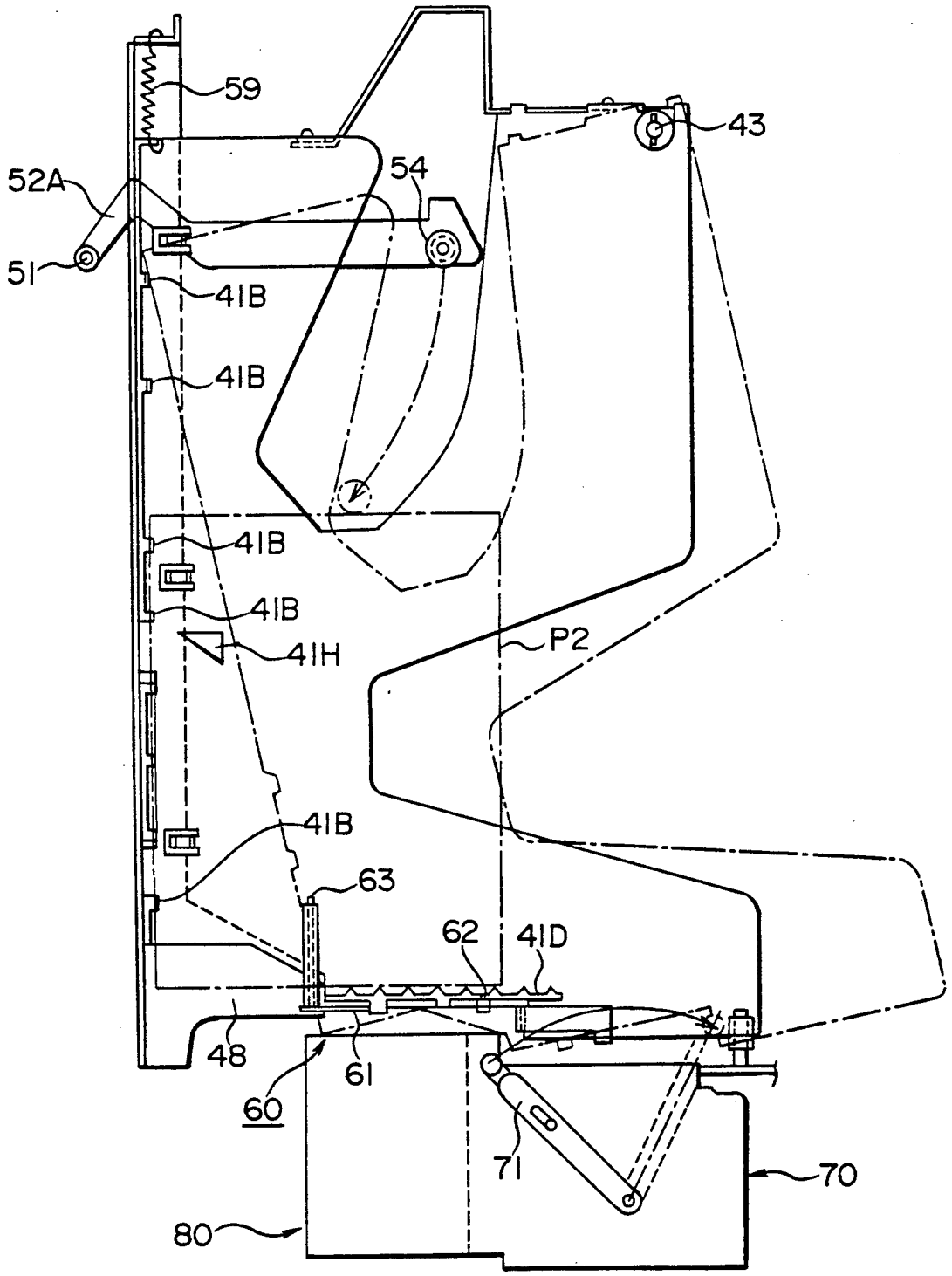
FIG. 17 is a plan view of a bin, alignment device and bin oscillating device.

In a portion of the fixed frame of the upward conveyance section 30, is provided the alignment device 50 which aligns the side edges of papers P discharged onto the bin 41 from the image forming apparatus 1. FIG. 16 is a sectional front view of the alignment device 50, and FIG. 17 is a plan view showing the bins 41, alignment device 50, and bin oscillating device 70.

The alignment device 50 is operated as follows. The rotating shaft 51 is vertically supported by the upper and lower portion of the fixed frame, and rotated by pulse motor M2 through a gear transmitting system. The upper arm 52A and lower arm 52B are engaged with the rotating shaft 51 in such a manner that they can be freely rotated. The upper and lower portion of the alignment rod 54 are supported by the upper arm 52A and lower arm 52B through the aligning bearings 53 so that the alignment rod 54 can be oscillated.

The resilient member coated on the outer peripheral surface of the alignment rod 54 is contacted with the side edge of paper P with light pressure so that paper P can be pressed against the stopper wall 41D provided on the side of the bin 41 in order to align the side of paper P.

The oscillating angles of the aforementioned upper arm 52A and lower arm 52B are changed according to the pulse number of the aforementioned pulse motor M2 so that an alignment operation can be conducted correspondingly to the size of discharged paper P.

The paper holding device 60 is provided on the outer side surface of the aforementioned stopper wall 41D. The lever 61 is rotatably supported by the shaft 62 mounted on the outer side surface of the stopper wall 41D. The paper holding member 63 is provided on one end portion of the lever 61. The other end of the aforementioned lever 61 is pressed by the arm 71 of the bin oscillating device 70. Since the lever 61 is pressed in the aforementioned manner, the lever 61 is oscillated so that the upper surface of paper P placed on the bin 41 is pressed. The paper holding operation is conducted in the manner described above.

The base plate of the aforementioned bin oscillating device 70 is mounted on the common frame together with the base plate of the stapling device 80, and the stapling device 80 is moved to the position of each bin 41 by a lift not shown in the drawing so that a bundle of papers P stacked on the aforementioned oscillated bin 41 can be entered into a gap formed in the stapling section, and then a staple is driven into the bundle of papers.

After the staple has been driven, the arm 71 is oscillated to be returned, and the bin 41 returns to the initial position being pushed by the spring.

Next, the stapling operation will be explained as follows which is conducted on a bundle of papers discharged onto the bin 41.

Figure 18:
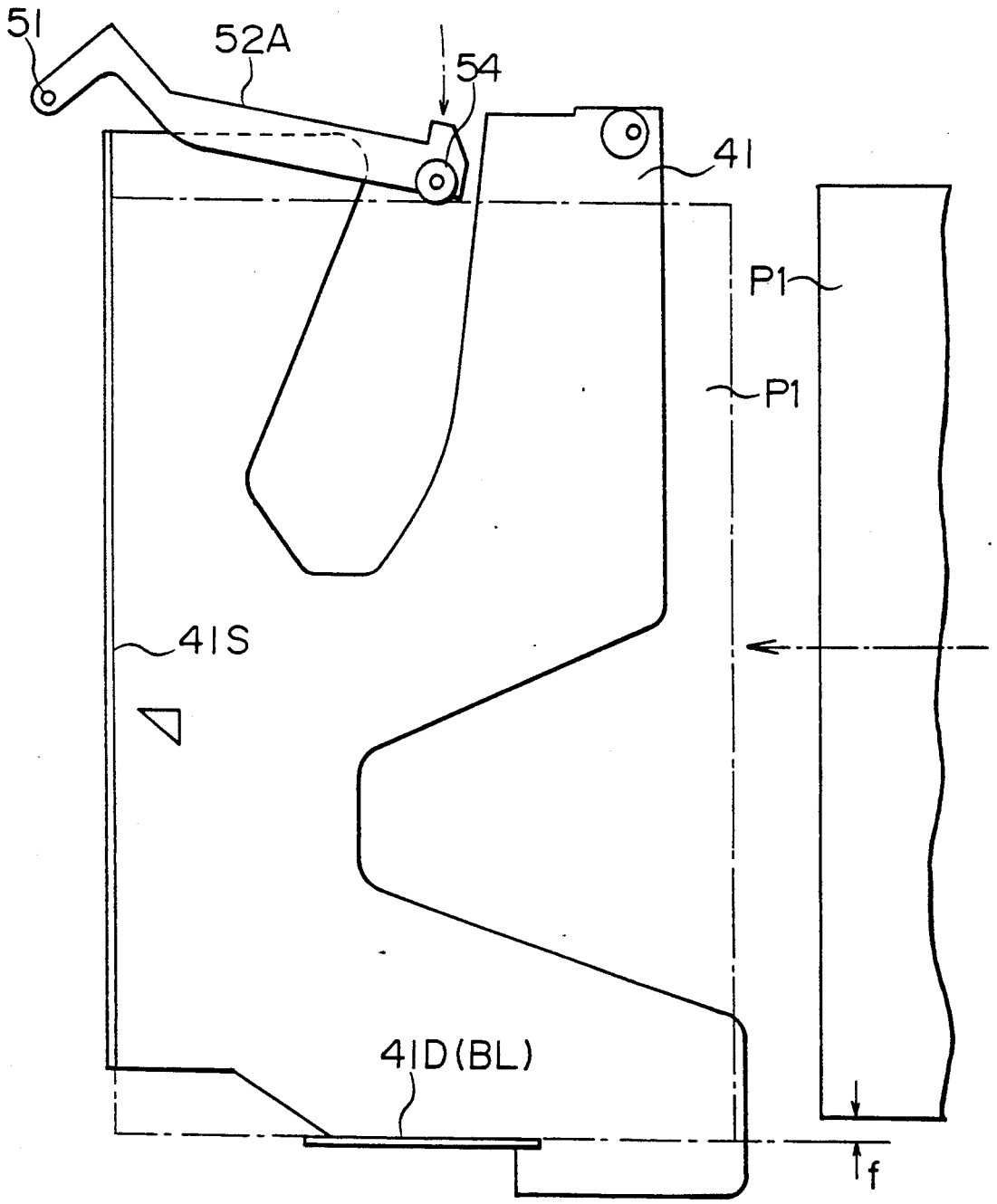
FIG. 18 is a plan view of the bin in which sheets of a large size are held.

FIG. 18 is a plan view showing the operation in which the maximum size of paper P1 (for example, a paper having the width of 17 inches) is discharged in such a manner that the center of the paper can coincide with the center line of the apparatus and the width is aligned. In this condition, the bin shift section 40 of the sorter is located in the home position, and the front surface of the bin shift section 40 is on the same surface as that of other fixed sections of the sorter such as the base frame 10, the downward conveyance section 20 and the upward conveyance section 30.

Figure 19:
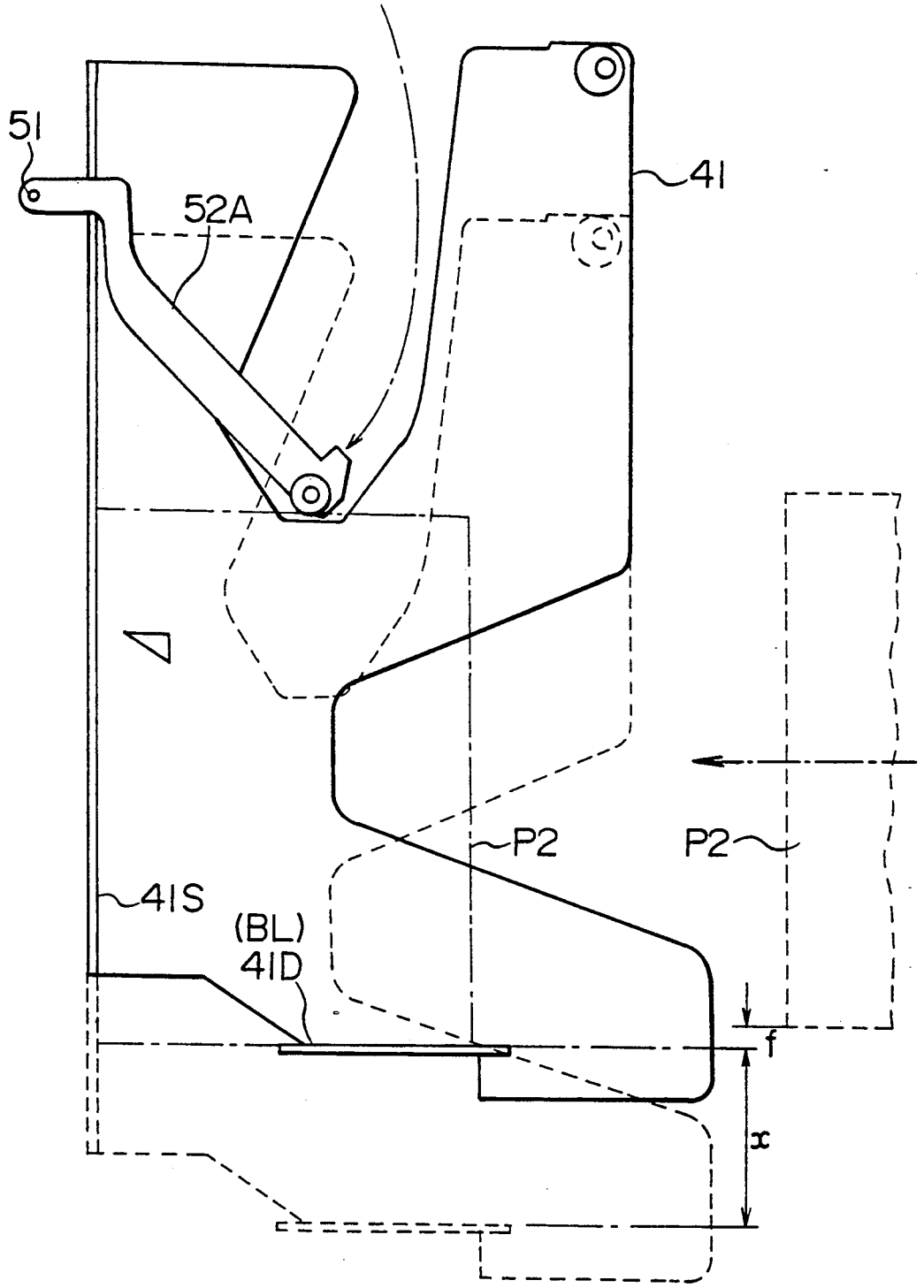
FIG. 19 is a plan view of the bin in which sheets of a small size are held.

FIG. 19 is a plan view showing the condition in which the minimum size of paper P2 (for example, B5 size, the width is 257 mm) is held in the bin 41 and aligned in such a manner that the center of the paper can coincide with the center line of the apparatus.

After all the bundles of papers have been stapled, the bundles are taken out from the bins 41. When all the bundles are removed from the bins 41, the optical path is opened which is formed by a light emitting element LED provided in the upper portion of the bin shift section 40, a light receiving element $PT_r$ provided in the lower portion, and the openings 41H, 49H. Then, a detection signal representing that there is no paper P on the bin 41, is emitted.

According to the detection signal, the bin shift section 40 is moved by a motor and a transmitting unit composed of a rack and pinion, resisting the spring force, so that the bin shift section 40 returns to the home position and prepares for the next operation. That is, when a sheet smaller than the maximum size (17 inches wide) is held, the bin shift section 40 is withdrawn from the operator's side to the opposite side as described above, and then the stapling operation is conducted. Accordingly, after all stapling operations have been completed, the bin shift section 40 is moved to the side opposite to the viewer's side.

Consequently, when the sorting operation is started, the bin shift section 40 of a large size is withdrawn according to the sheet size so that the sheet is held, aligned and stapled.

With reference to the attached drawings, the fourth embodiment of the present invention will be explained as follows.

Like parts in each of the views are identified by the same reference character. Only the points different from the aforementioned third embodiment will be explained.

Figure 20:
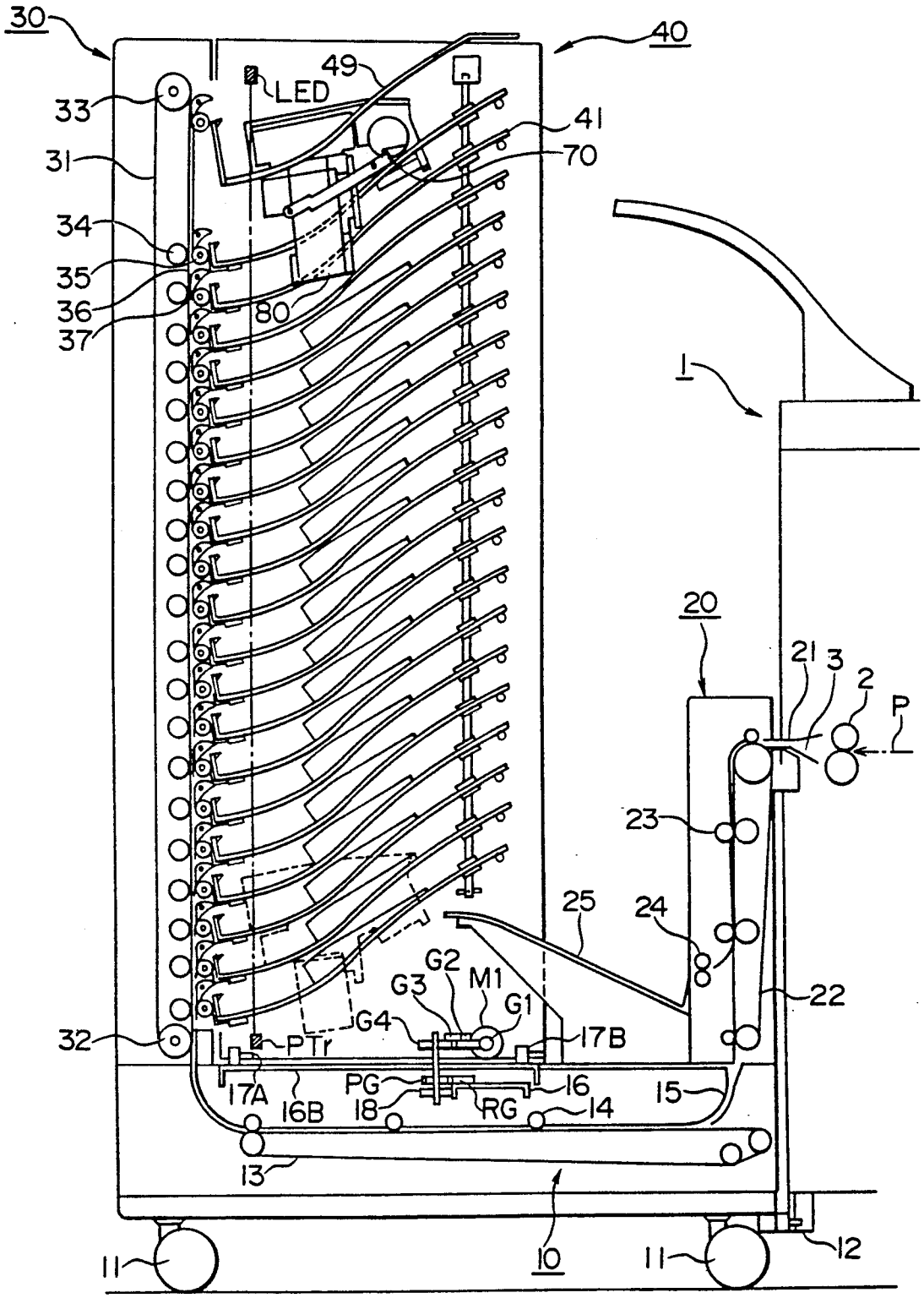
FIG. 20 is a view of a sorter of the fourth embodiment which is connected with an image forming apparatus.

FIG. 20 is a view showing the structure of a sorter connected with an image forming apparatus (for example, a copier) 1. The sorter of the present invention is composed of a base frame 10, downward conveyance section 20, upward conveyance section 30, and bin shift section 40.

Figure 21:
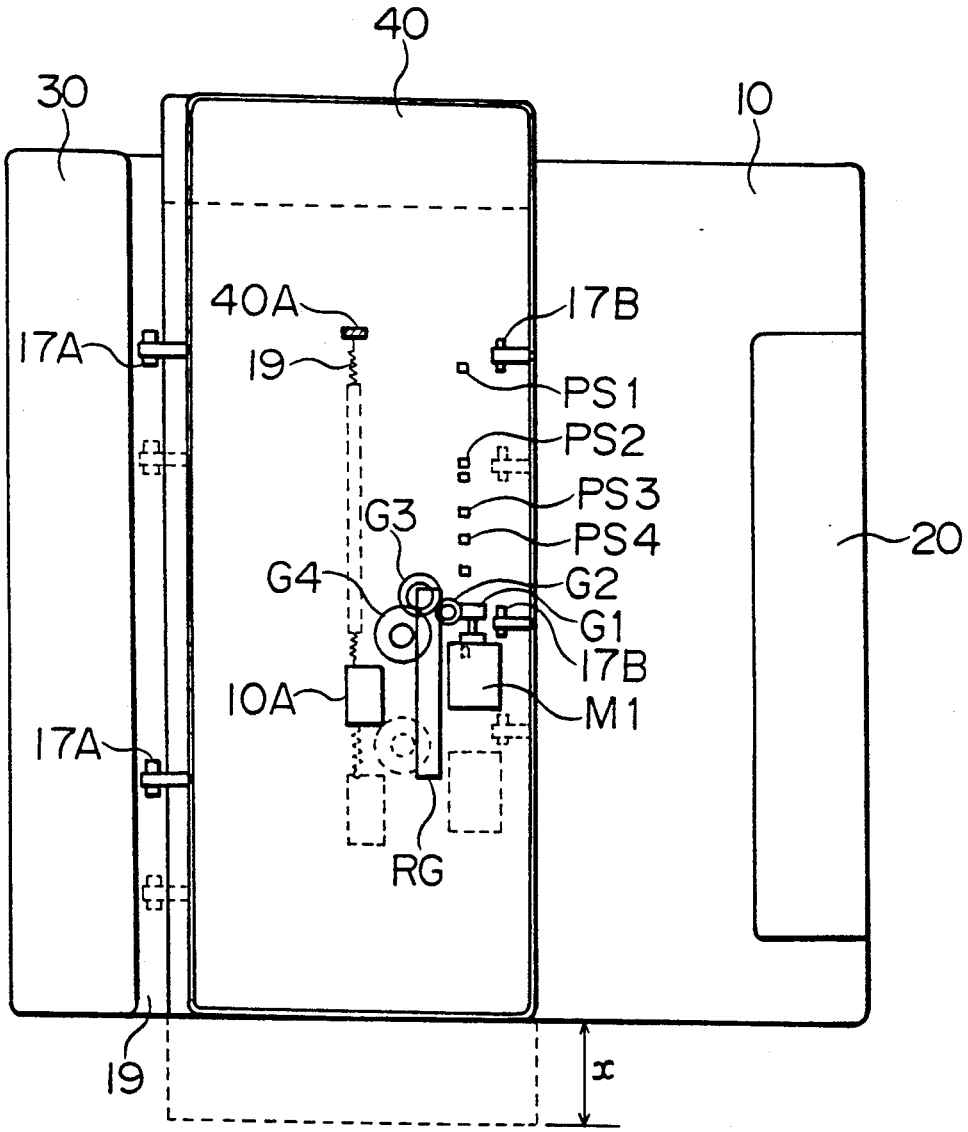
FIG. 21 is a plan view of a base frame and bin shift section drive means.

FIG. 21 is a plan view showing the base frame 10 and the bin shift section drive means.

Inside the frame of the bin shift section 40, rollers 17A (the left two rollers in FIG. 21) and 17B (the right two rollers) are rotatably supported, and the rollers 17A, 17B are slid on rails 16B of the aforementioned base frame 10 so that the frame of the bin shift section 40 can be moved in the direction perpendicular to the surface of the drawing.

Motor M1 is provided inside the frame of the aforementioned bin shift section 40, and rotates pinion gear PG through worm gear G1 and reduction gear trains G2, G3, G4. Since pinion gear PG meshes with rack gear RG fixed to the aforementioned stay 16, the frame of the bin shift section 40 is moved to a position illustrated by a broken line in FIG. 21 when Motor M1 is rotated. Numeral 18 is a rotatable roller mounted on the shaft of the aforementioned pinion gear PG. The roller 18 comes into contact with the aforementioned stay 16 so as to guide. Numeral 19 is a tension spring stretched between the engaging portion 10A of the base frame and the engaging portion 40A provided to a portion of the bin shift section 40 so that the bin shift section 40 can be pushed in a direction by the force of the spring.

By the tension of the aforementioned coil spring 19, the frame of the aforementioned bin shift section 40 is always pulled. Consequently, backlash caused among pinion gear PG rotatably provided to the frame, reduction gear trains G2, G3, worm gear G1, and rack gear RG fixed to the base frame 10, is absorbed by the tension of the aforementioned coil spring 19 and the aforementioned gears are pushed in one direction with pressure. When the bin shift section 40 is advanced by the normal rotation of motor M1 through the aforementioned gear trains, the bin shift section 40 is moved to a position illustrated by a broken line (the maximum amount of movement is X) in the drawing, resisting the tension of the aforementioned coil spring 19. When motor M1 is rotated reversely, the aforementioned gear trains are reversed by the tension of the aforementioned coil spring 19 while the gear trains are pushed in one direction, and then the bin shift section 40 is returned to the initial section illustrated by a solid line in the drawing.

Figure 22:
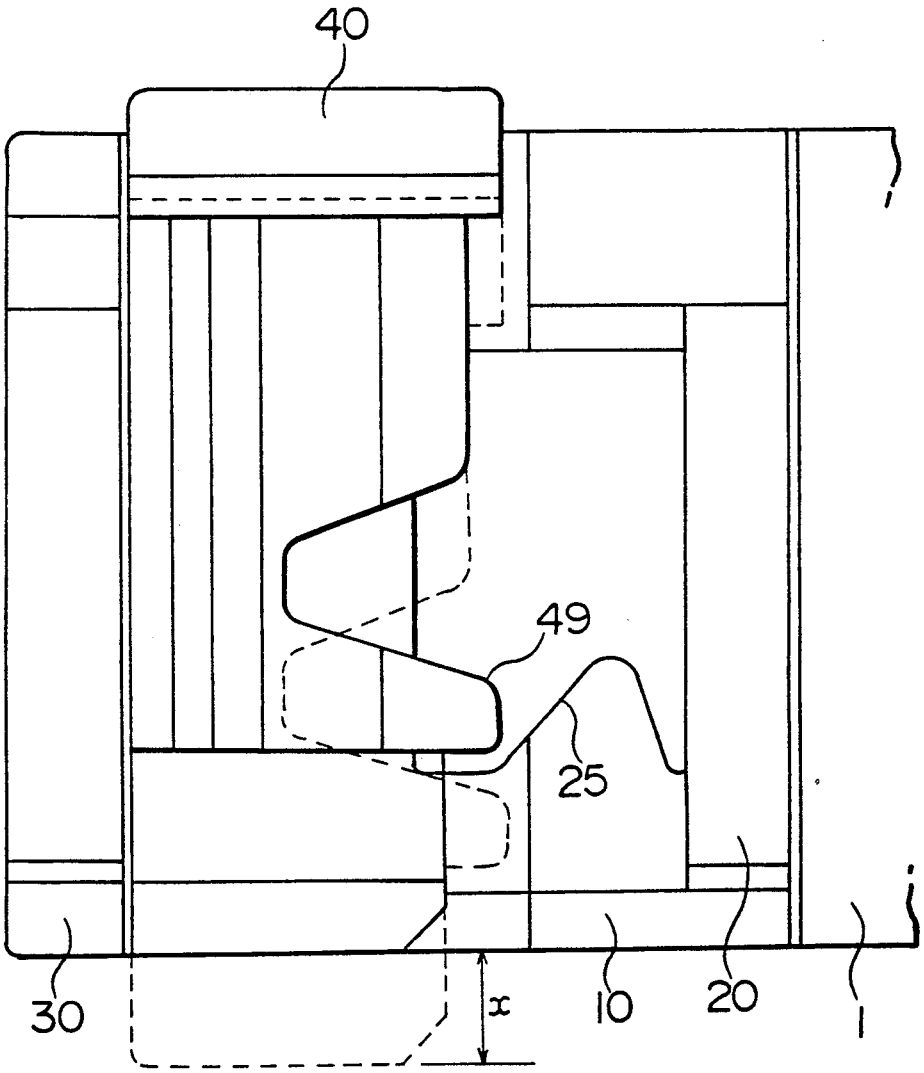
FIG. 22 is a plan view of a sorter.
Figure 24:
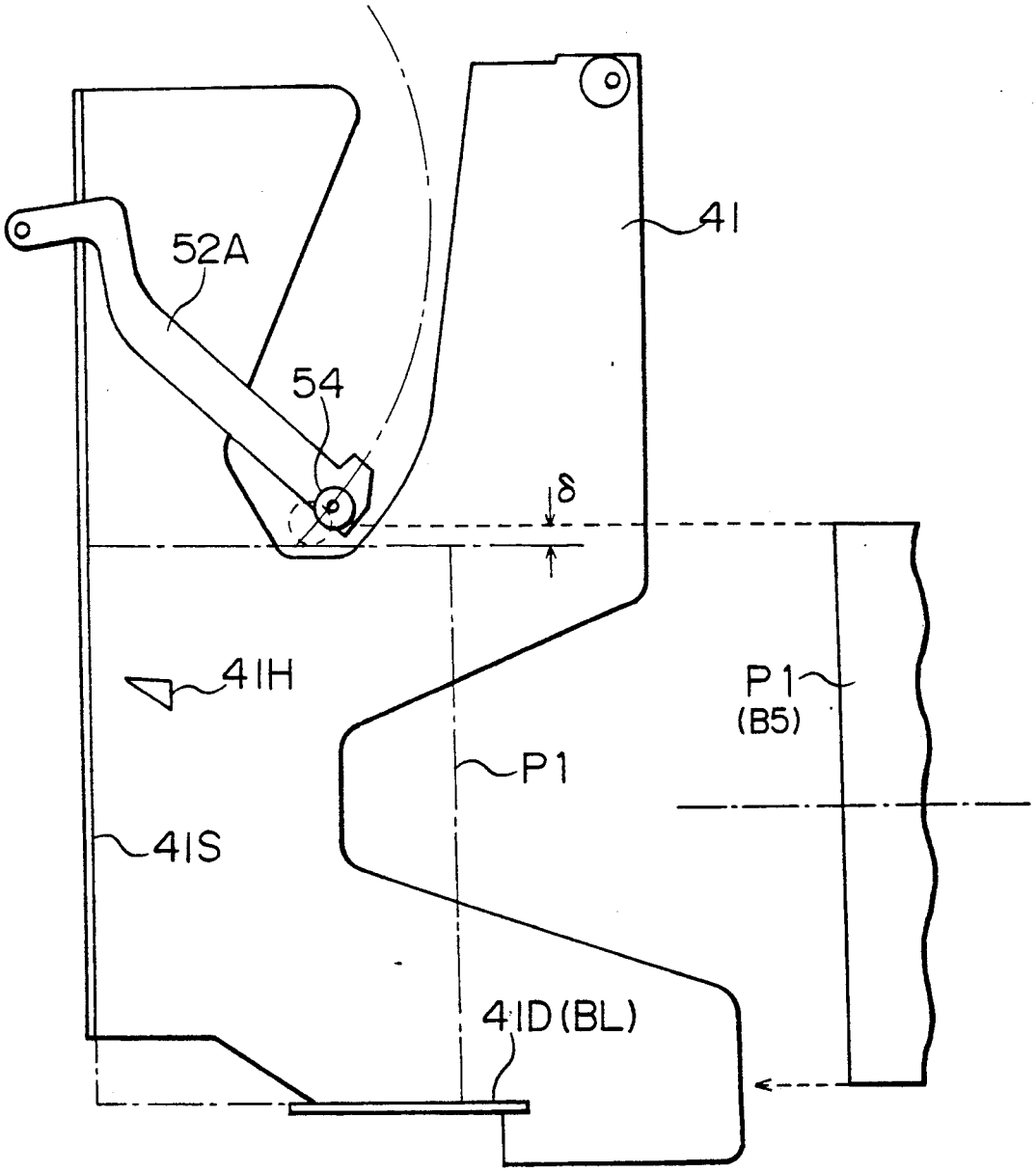
FIG. 24 is a plan view of a bin in which sheets of a small size are held.

FIG. 22 is a plan view of the sorter showing the operation of the bin shift section 40. FIG. 24 is a view showing the appearance of the sorter. A solid line in the view represents a condition in which the bin shift section 40 is located in the home position, and a broken line represents a condition in which the bin shift section 40 is returned.

When smaller sheets than the maximum size are held in the bins, all the bins are advanced to the operator's side.

When sheets of middle size such as A3, B4 and A4, are held in the bins, one of the aforementioned photosensors PS1–PS4 is designated according to a sheet size setting signal in the bin shift section 40, so that the drive distance by motor M1 can be controlled, and the bin shift section 40 is stopped at a predetermined middle position.

Figure 23:
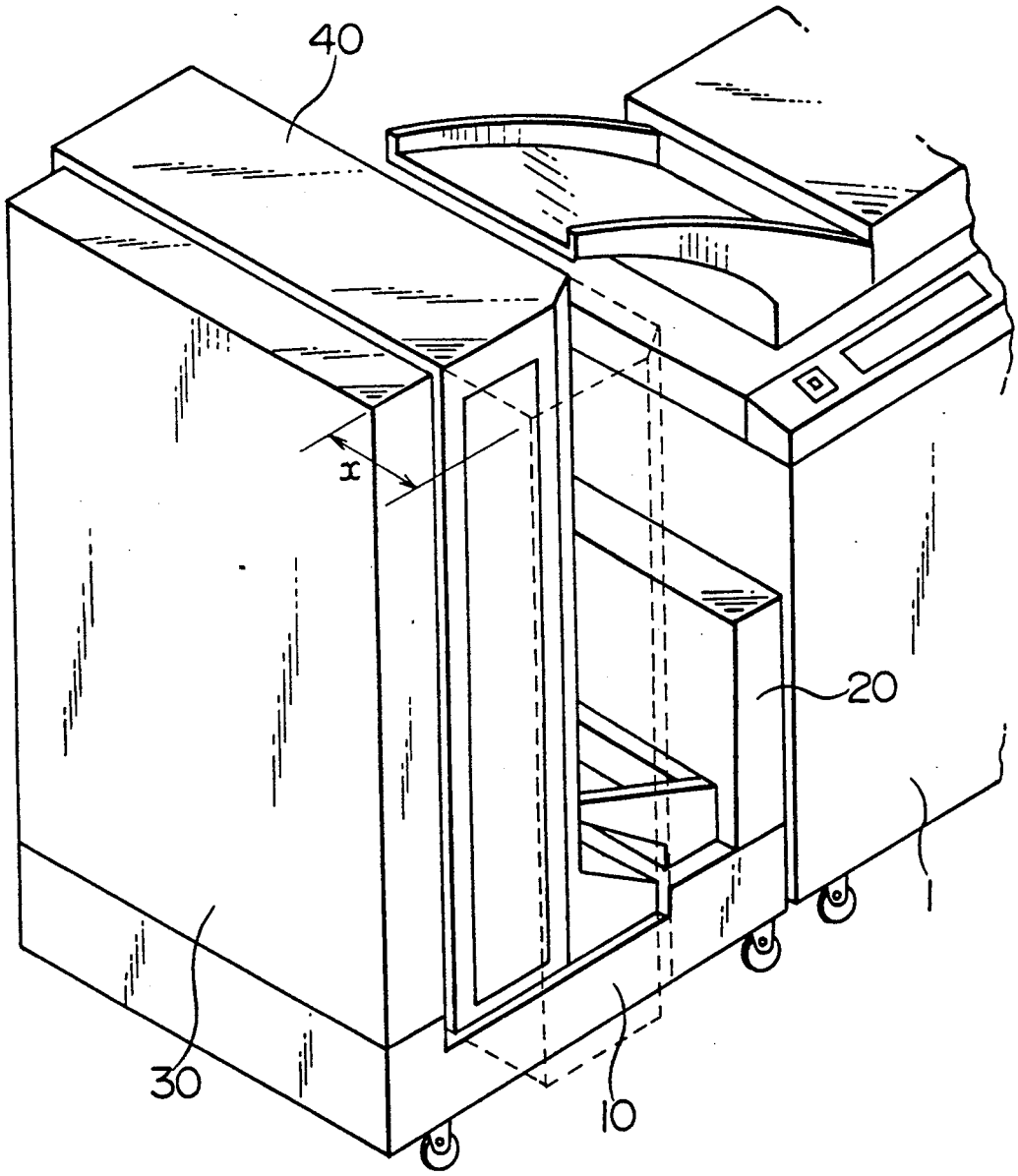
FIG. 23 is a view showing the appearance of the sorter.

In the stapling device provided with the sorter, in order to insert stacked papers P into the stapling device, all bins 41 are advanced or withdrawn correspondingly to the size of paper together with the bin shift section 40 by motor M1 as shown in FIGS. 21, 22, and 23, and further each bin is respectively oscillated around the fixed support shaft 43.

FIG. 24 is a plan view showing the operation in which paper P1 of the minimum size (for example, B5 size, the width of which is 257 mm) is discharged in such a manner that the center of paper P coincides with the center of the apparatus, and aligned with regard to the width. In this condition, the bin shift section 40 of the sorter is located in the home position, and the most front surface of the bin shift section 40 is on the same surface as that of other fixed portions of the sorter such as the base frame 10, the downward conveyance section 20 and the upward conveyance section 30.

Figure 25:
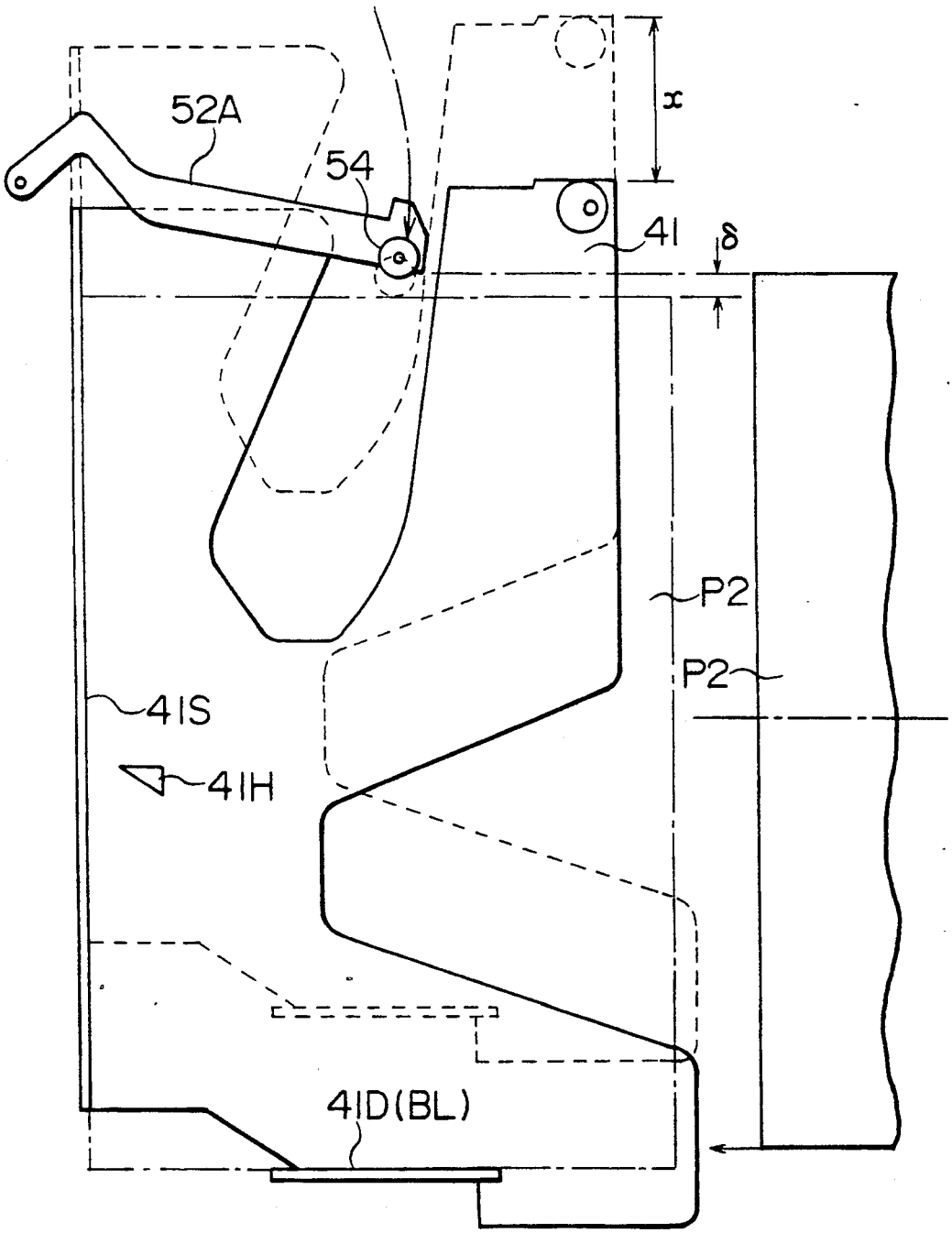
FIG. 25 is a plan view of a bin in which sheets of a large size are held.

FIG. 25 is a plan view showing the condition in which papers P of the maximum size (for example, ledger size, the width of which is 17 inches) are held in the bins 41 and aligned in such a manner that the center of papers P coincide with the center line of the apparatus.

According to a signal representing that there is no paper on in each of the bins 41, the bin shift section 40 is withdrawn by the torque of a motor transmitted through a transmitting mechanism including a rack and pinion, resisting the force of the coil spring 19, and returned to the home position to be prepared for the successive operation. That is, when sheets larger than the minimum size, are held in the bins, the bin shift section 40 advances to the operator's side and a stapling operation is conducted as described above. Accordingly, after the stapling operations of all sheets have been completed, the bin shift section 40 advances to the side opposite to the operator's side and returns to the home position. Consequently, at the time when the sorter starts its operation, the large-sized bin shift section 40 advances to a predetermined position correspondingly to the sheet size to hold, align and staple the sheets.

Figure 26:
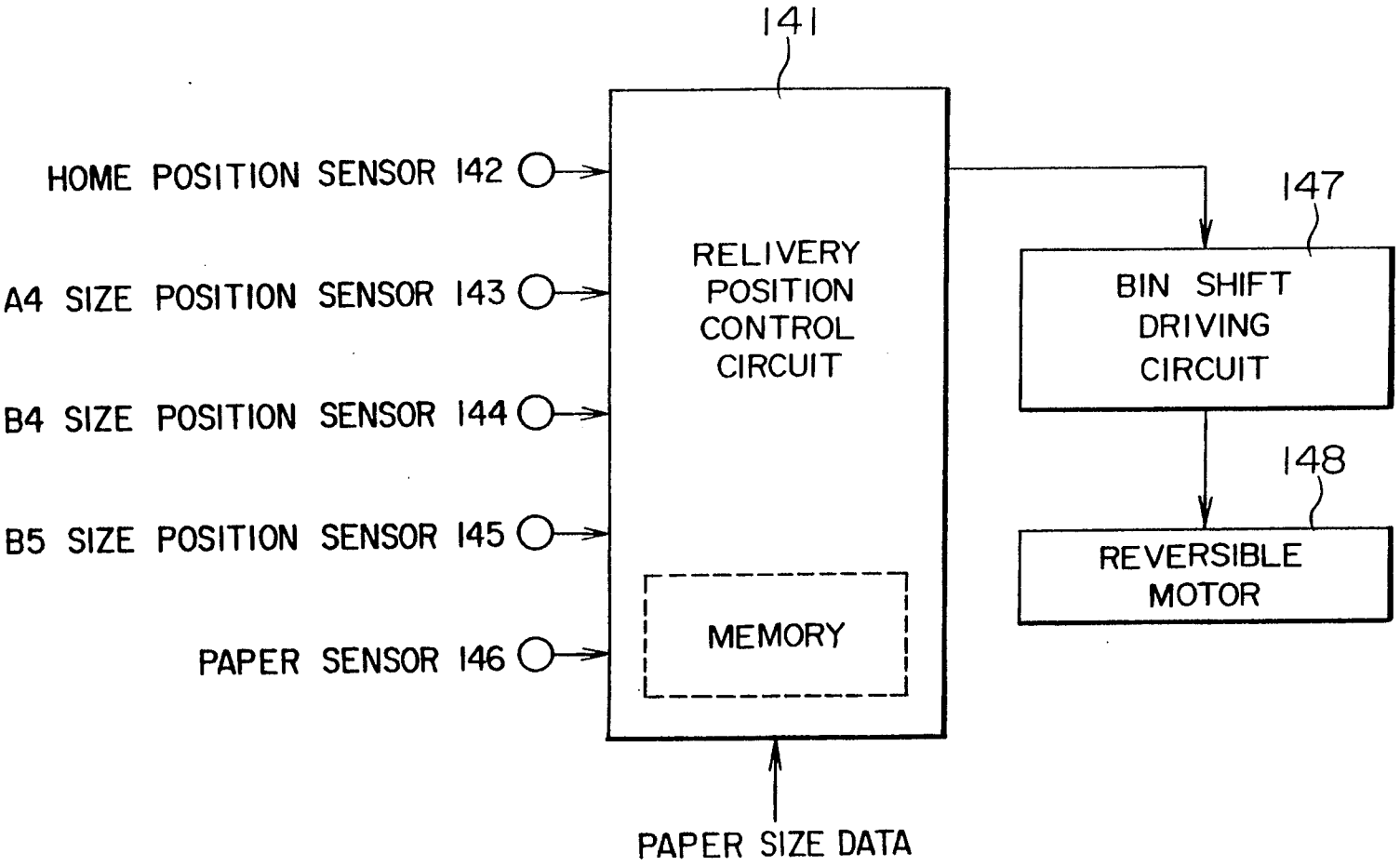
FIG. 26 is a block diagram of control of the bin shift section of the fifth embodiment according to the present invention.
Figure 27:
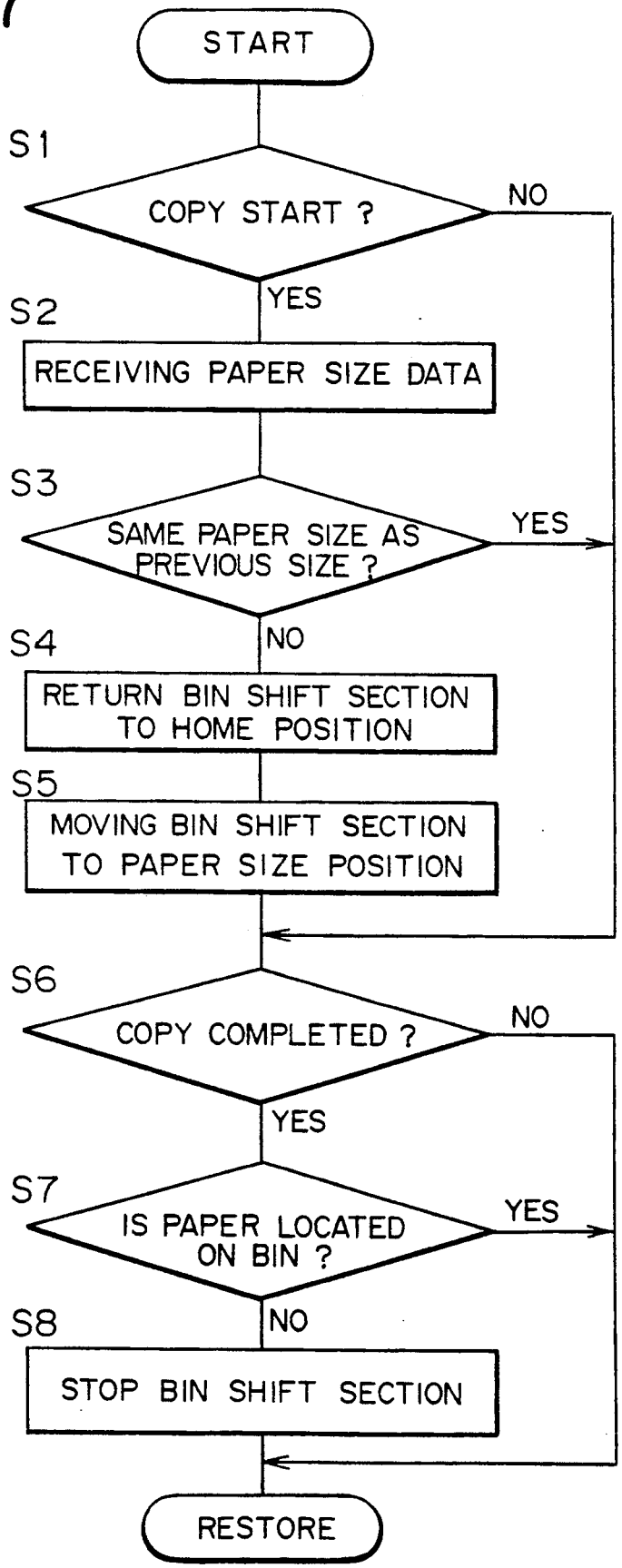
FIG. 27 is a flow chart of shift control of the fifth embodiment of the present invention.
Figure 28:
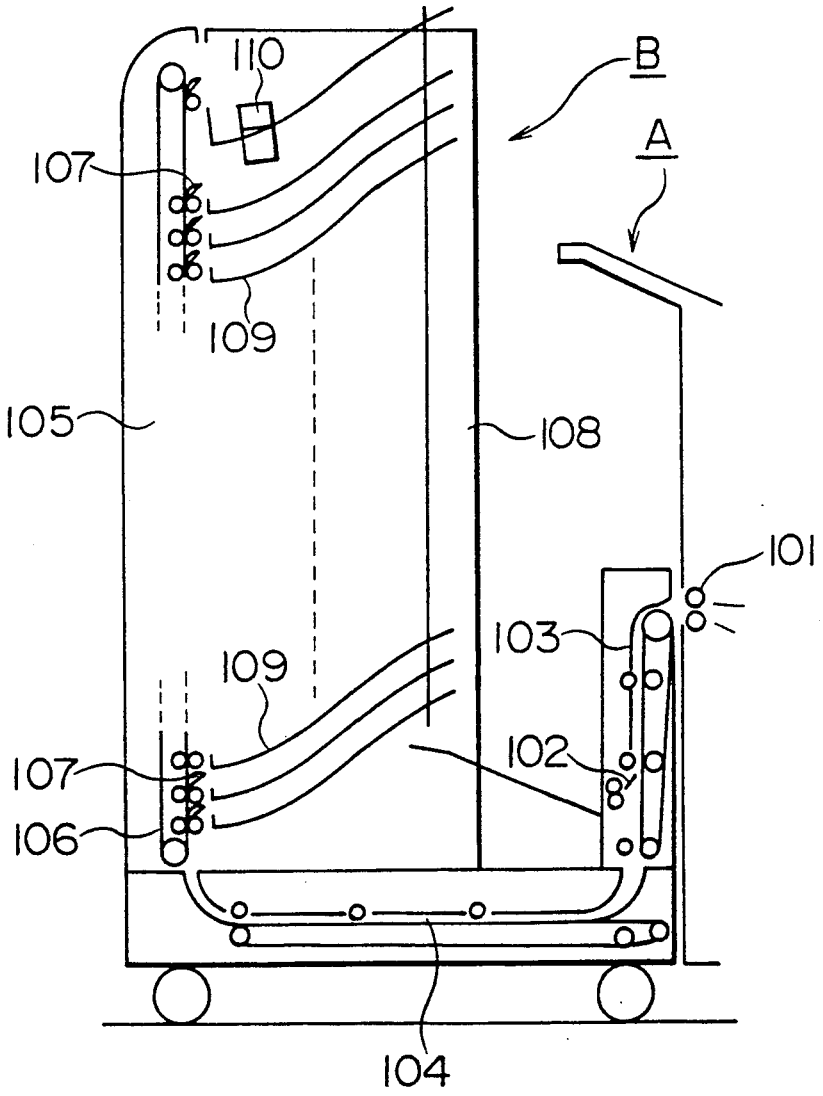
FIG. 28 is a view showing the outline of a sorter provided with a stapler.
Figure 29:
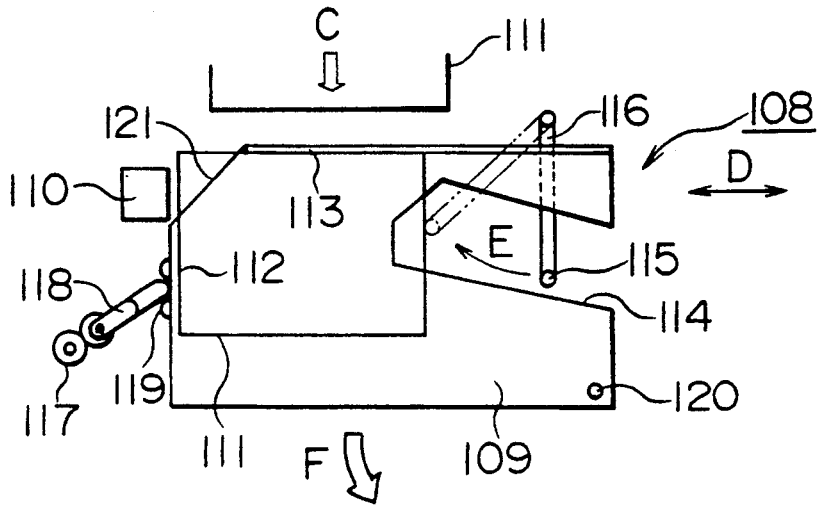
FIG. 29 is a view explaining the motion of the sorter provided with the stapler.
Figure 30:
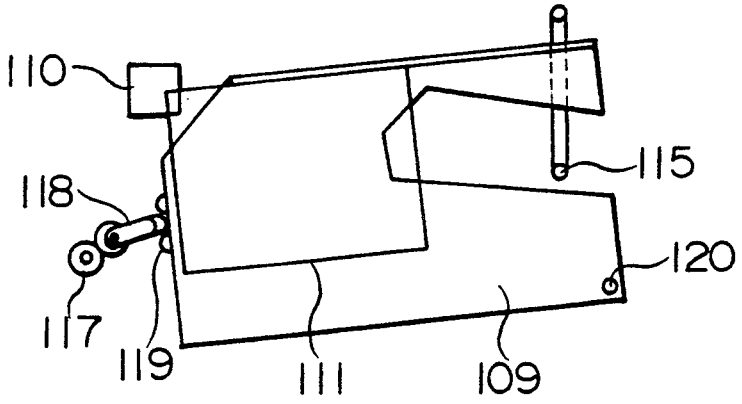
FIG. 30 is a view explaining the motion of the sorter provided with the stapler.

The fifth embodiment of the present invention will be explained as follows. FIG. 26 is a block diagram to control the movement of a bin shift section 108 of the embodiment. FIG. 27 is a flow chart of the control. In FIG. 26, a discharged paper position control section 141 includes a microcomputer and the like. Into the discharged paper position control section 141, are inputted the detection signals of a waiting position sensor 142, A4 size position sensor 143, B4 size position sensor 144, B5 size position sensor 145, and paper sensor 146 which detects the paper on the bin 109. Data of the paper size which has been obtained in copier A is also inputted into the discharged paper position control section 141. In the discharged paper position control section 141, there is provided a memory used to store the position of a paper discharged last time. Numeral 147 is a bin shift section drive circuit which is used to move the bin shift section 108 in the direction of arrow D, and numeral 148 is a reversible motor used to drive the bin shift drive section 147.

As shown in FIG. 27, when a copying operation is started in this embodiment (step S1), data of the paper size is taken in (step S2), and the data is compared with the size of a copy paper which has been used in the prior copying operation (step S3). In the case where the prior data and that of the present time are different, a drive signal is outputted into the bin shift section drive circuit 147 from the discharged paper position control circuit 141 so that the motor 148 is rotated. Then, the bin shift section 108 is once moved toward the waiting position, and stopped at the time when the waiting position sensor 142 detects the bin shift section 108 (step S4). At this time, the bin shift section 108 is located in the waiting position, and further moved again to a position corresponding to the size data of the paper which has been taken in. For example, when the paper size is "A4", the bin shift section 108 is moved until the A4 size position sensor 143 detects the bin shift section 108 (step S5). After that, A4 size papers relating to the copy operation are stacked on the bin 109. When it is judged in step S3 that the size of papers taken in step S2 is the same as the size of the last time, the bin shift section 108 is not moved.

When the copying operation has been completed (step S6), the detection signal of the paper sensor 146 is taken in, and it is judged whether papers are left in the bin 109 or not (step S7). When all the papers have been carried away, the bin shift section 108 is stopped at the position (step S8).

The waiting position may be selected to be a position corresponding to the maximum size, the minimum size or the most frequently used size of sheets.

As explained above, when bundles of sheets are taken out of the bins after all the sorting and stapling operations have been conducted on the sheets, the bin shift section of the sorter is withdrawn to the side opposite to the operator and returned to the position in which the sheets of the minimum size can be held. Therefore, the operator is no danger from the large-sized bin shift section since it is moved to the side opposite to the operator. Accordingly, accidents can be prevented when the bin shift section is moved.

According to the present invention, after the bin shift section of the sorter has been moved correspondingly to the paper sizes, papers are held in the bins. Therefore, the amount of movement of papers to be sorted can be maintained constant in any sizes, so that the force added to papers by the alignment rod is constant and paper alignment can be remarkably improved. Due to the foregoing, papers can be accurately aligned after image formation. Especially when a stapling or drilling operation is conducted, the stapling position can be easily stabilized, and the stapling device can be accurately set at a predetermined position of the papers by a simple structure, so that a bundle of papers can be accurately and positively stapled.

Further, according to the present invention, when the bin shift section is located in the home position, the front side of the bin shift section is approximately on the same surface as the front side of the sorter and the image forming apparatus connected with the sorter, and when the papers discharged from the image forming apparatus are sent to the sorter, the bin shift section is withdrawn to the side opposite to the operator correspondingly to the sheet size. Accordingly, the movement of the bin shift section does not exert pressure upon the operator, and the bin shift section is not blocked by the operator and other objects located on the front side, so that safety can be ensured. In the conventional sorter, the bin shift section of which is advanced to the front side exceeding the front surface of the sorter, there is a possibility of failure or accident when the operator puts his hand on the bin shift section which is advancing to the front side, or when the bin shift section bumps against an object located on the front side.

Furthermore, according to the present invention, even when there is play or back-lash in the drive means of the bin shift section, it can be absorbed since the drive means is pushed in one direction by the tension of a spring. Therefore, the bin shift section can be accurately positioned when it reciprocates. Consequently, a bundle of papers can be accurately set in a predetermined position so that it can be positively stapled. Allowance of the composing members in the manufacturing process and accuracy of positioning can be made sufficiently wide in the apparatus of the present invention, so that the manufacturing cost can be effectively reduced, and further the bin shift section can be smoothly and lightly moved.

Furthermore, in the apparatus of the present invention, only when the paper sizes are different, the paper discharging position is moved, in other words, the bins are moved to the positions corresponding to the size, so that the frequency of movement can be decreased. Therefore, the frequency of occurrence of noise and disorder of papers can be decreased.

What is claimed is:

1. A sorter provided with a stapler for use with an image forming apparatus, said image forming apparatus including means for delivering recording sheets from said apparatus in a delivery direction, said sorter comprising:

(a) a plurality of bins each for accommodating recording sheets of various sizes delivered from said apparatus;

(b) means for aligning edges of the accommodated sheets, and including means for pushing the sheets toward a reference wall on each of said bins in a substantially horizontal direction which is also at a right angle to the delivery direction of the sheets;

(c) a casing for housing said plurality of bins, integrated into a unit, said casing being movable in said substantially horizontal direction at said right angle to the delivery direction of the sheets; and (d) means for moving said casing in said substantially horizontal direction, by an about corresponding to a width of sheets, a home position of said casing being set to a position in which sheets having a minimum size in width are accommodated without moving of said casing.

2. The sorter of claim 1 further comprising detecting means for detecting the sheets on said plurality of bins, wherein when said detecting means detects that all the sheets have been taken out from said plurality of bins after accommodating sheets larger than the minimum size in width, said casing is moved to the home position.

3. The sorter of claim 1, wherein said delivering means delivers said sheets such that a center of said sheets delivered from said apparatus is always located at a fixed position.

4. A sorter provided with a stapler for use with an image forming apparatus, said image forming apparatus including means for delivering recording sheets from said apparatus in a delivery direction, said sorter comprising:

(a) a plurality of bins each for accommodating recording sheets of various sizes delivered from said apparatus;

(b) means for aligning edges of the accommodated sheets, and including means for pushing the sheets toward a reference wall on each of said bins in a substantially horizontal direction which is also at a right angle to the delivery direction of the sheets, an amount of a pushing stroke being almost constant independently of the size of the sheets;

(c) a casing for housing said plurality of bins, integrated into a unit, said casing being movable in said substantially horizontal direction at said right angle to the delivery direction of the sheets; and (d) means for moving said casing corresponding to a width of sheets, said casing being moved by a predetermined distance in accordance with a size of the sheets accommodated in said plurality of bins.

5. The sorter of claim 4, wherein said delivering means delivers said sheets such that a center of said sheets delivered from said apparatus is always located at a fixed position.

6. A sorter provided with a stapler for use with an image forming apparatus, said image forming apparatus including means for delivering recording sheets from said apparatus in a delivery direction, said sorter comprising:

(a) a plurality of bins each for accommodating recording sheets of various sizes delivered from said apparatus;

(b) means for aligning edges of the accommodated sheets, and including means for pushing the sheets toward a reference wall on each of said bins in a substantially horizontal direction which is also at a right angle to the delivery direction of the sheets;

(c) a casing for housing said plurality of bins, integrated into a unit, said casing being movable in said substantially horizontal direction at said right angle to the delivery direction of the sheets; and (d) means for moving said casing in said substantial horizontal direction, by an amount corresponding to a width of sheets, a home position of said casing being set to a position in which sheets having the maximum size in width are accommodated without moving of said casing.

7. The sorter of claim 4 wherein the home position is set to a position in which said casing is flush with a front surface of a main body of said sorter.

8. The sorter of claim 6, further comprising means for detecting the sheets on said plurality of bins, wherein when a detection is made to show that all the sheets have been taken out from said plurality of bins, said casing is moved to the home position.

9. The sorter of claim 6, wherein said delivering means delivers said sheets such that a center of said sheets delivered from said apparatus is always located at a fixed position.

10. A sorter provided with a stapler for use with an image forming apparatus, said image forming apparatus including means for delivering recording sheets from said apparatus in a delivery direction, said sorter, comprising:

(a) a plurality of bins each for accommodating recording sheets of various sizes delivered from said apparatus;

(b) means for aligning edges of the accommodated sheets, and including means for pushing the sheets toward a reference wall on each of said bins in a substantially horizontal direction which is also at a right angle to the delivery direction of the sheets;

(c) a casing for housing said plurality of bins, integrated into a unit, said casing being movable in said substantially horizontal direction at said right angle to the delivery direction of sheets;

(d) means for driving said casing; and (e) a tension member for generating tension force between a fixed portion of a main body of said sorter and said casing, for adsorbing at least horizontal play among components of said driving means.

11. The sorter of claim 10, wherein said delivering means delivers said sheets such that a center of said sheets delivered from said apparatus is always located at a fixed position.

12. A sorter for use with an image forming apparatus, comprising:

(a) a bin receiving recording sheets delivered from said apparatus, said bin being movable in accordance with a size of the recording sheets;

(b) means for comparing a size of recording sheets which will be received with a size of recording sheets which have been previously received; and (c) means for moving said bin to a position in accordance with the size of recording sheets which will be received when both of the sizes are different from each other.

13. The sorter of claim 12 wherein said bin is moved from a home position to the position in accordance with the size of the recording sheets.

14. The sorter of claim 13, wherein the home position is a position in accordance with the maximum size of sheets.

15. The sorter of claim 13 wherein the home position is a position in accordance with the minimum size of sheets.

16. The sorter of claim 13, wherein the home position is a position in accordance with the most frequently used size of sheets.

* * * * *